US007275788B2

(12) United States Patent
Dettmann et al.

(10) Patent No.: US 7,275,788 B2
(45) Date of Patent: Oct. 2, 2007

(54) MUSIC POSTURE CHAIRS

(75) Inventors: Thomas Dettmann, New Prague, MN (US); Paul James, Minneapolis, MN (US); Diwa Ratnam, Woodbury, MN (US); Jodi Tuthill, Waterville, MN (US); Mark Reeves, Mahtomedi, MN (US); Terry Strand, Owatonna, MN (US); Patrick Weber, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 0 days.

(21) Appl. No.: 11/198,023

(22) Filed: Aug. 5, 2005

(65) Prior Publication Data

US 2006/0103198 A1 May 18, 2006

Related U.S. Application Data

(60) Provisional application No. 60/649,196, filed on Feb. 2, 2005, provisional application No. 60/599,314, filed on Aug. 5, 2004.

(51) Int. Cl.
*A47C 3/04* (2006.01)
*A47C 7/16* (2006.01)

(52) U.S. Cl. ..... 297/239; 297/445.1; 297/448.1; 297/448.2; 297/449.1; 297/451.11; 297/452.12; 297/452.14; 297/452.21; 297/452.22; 297/452.23; 297/452.24; 297/452.25

(58) Field of Classification Search ..... 297/445.1, 297/448.1, 449.1, 451.11, 452.12, 452.14, 297/452.21, 452.22, 452.23, 452.24, 452.25, 297/239

See application file for complete search history.

(56) References Cited

U.S. PATENT DOCUMENTS

| | | | | | |
|---|---|---|---|---|---|
| 141,374 | A | * | 7/1873 | Myers | 297/452.22 |
| 271,757 | A | * | 2/1883 | Woodman | 297/452.22 X |
| D29,994 | S | | 1/1899 | Dennett | |
| 667,591 | A | * | 2/1901 | Smith | 297/452.22 |
| 669,112 | A | * | 3/1901 | Braasch | 297/452.23 |
| D101,404 | S | | 9/1936 | Salomon | |
| 2,098,888 | A | | 11/1937 | Schädler | |
| D108,750 | S | | 3/1938 | Michelson | |
| 2,146,932 | A | | 2/1939 | Boman | |
| 2,380,102 | A | * | 7/1945 | Farmer | 297/452.24 X |
| D142,800 | S | * | 11/1945 | Watson | 297/452.12 X |
| D146,347 | S | | 2/1947 | Clairmonte et al. | |
| 2,554,490 | A | * | 5/1951 | Eames | 297/451.11 X |
| 2,634,371 | A | | 4/1953 | Masters | |
| 2,658,563 | A | * | 11/1953 | Nordmark | 297/452.24 |

(Continued)

FOREIGN PATENT DOCUMENTS

| | | | | | |
|---|---|---|---|---|---|
| CH | 660840 | A5 | * | 5/1987 | 297/445.1 |

(Continued)

OTHER PUBLICATIONS

United States; U.S. Appl. No. 09/437,965; not yet issued.

(Continued)

*Primary Examiner*—Rodney B. White
(74) *Attorney, Agent, or Firm*—Patterson, Thuente, Skaar & Christensen, P.A.

(57) ABSTRACT

Chairs for encouraging proper posture for performers, including vocalists and instrumentalists. Chairs allow for maintenance of proper posture by performers seated in engaged and in perched positions.

19 Claims, 46 Drawing Sheets

U.S. PATENT DOCUMENTS

| | | | | | |
|---|---|---|---|---|---|
| 2,745,468 | A | | 5/1956 | Kramer | |
| D181,241 | S | | 10/1957 | Swanson | |
| 2,808,875 | A | * | 10/1957 | Bargen | 297/452.14 |
| 2,874,755 | A | | 2/1959 | Smith | |
| 2,990,876 | A | * | 7/1961 | Brook | 297/452.12 X |
| 3,276,818 | A | * | 10/1966 | Durfee et al. | 297/448.1 |
| 3,328,075 | A | * | 6/1967 | Albinson | 297/448.1 X |
| 3,389,936 | A | | 6/1968 | Drabert | |
| 3,393,941 | A | * | 7/1968 | Grosfillex | 297/448.1 X |
| 3,450,435 | A | * | 6/1969 | Stephens | 297/452.12 X |
| 3,463,547 | A | * | 8/1969 | Brennan et al. | 297/452.25 |
| 3,512,835 | A | * | 5/1970 | Flototto | 297/452.14 |
| 3,594,041 | A | | 7/1971 | Rye | |
| 3,669,496 | A | * | 6/1972 | Chisholm | 297/448.1 |
| 3,671,074 | A | | 6/1972 | Bergstrom | |
| 3,708,202 | A | | 1/1973 | Barecki | |
| D236,862 | S | | 9/1975 | Grosfillex | |
| 3,904,243 | A | * | 9/1975 | Kostelec et al. | 297/448.1 X |
| 4,148,523 | A | | 4/1979 | Brand et al. | |
| 4,152,023 | A | * | 5/1979 | Buhk | 297/452.14 X |
| D252,904 | S | | 9/1979 | Springfield | |
| 4,240,663 | A | | 12/1980 | Locher | |
| 4,522,444 | A | | 6/1985 | Pollock | |
| 4,529,247 | A | * | 7/1985 | Stumpf et al. | 297/452.14 X |
| 4,589,023 | A | | 5/1986 | Suzuki et al. | |
| 4,595,234 | A | | 6/1986 | Kjersem | |
| D290,070 | S | | 6/1987 | Lange | |
| 4,671,570 | A | | 6/1987 | Hockenberry | |
| D290,789 | S | | 7/1987 | Lange | |
| 4,690,459 | A | | 9/1987 | Ullman | |
| D294,319 | S | | 2/1988 | Troup et al. | |
| 4,784,435 | A | | 11/1988 | Leib | |
| 4,786,105 | A | | 11/1988 | Sheehan et al. | |
| 4,787,672 | A | | 11/1988 | Werner | |
| 4,892,355 | A | * | 1/1990 | Fend | 297/452.14 X |
| 5,002,337 | A | * | 3/1991 | Engel et al. | 297/449.1 X |
| 5,076,646 | A | * | 12/1991 | Matte | 297/452.14 |
| D323,943 | S | | 2/1992 | Piretti | |
| 5,154,474 | A | | 10/1992 | Desanta | |
| 5,167,436 | A | | 12/1992 | Wu | |
| D336,795 | S | | 6/1993 | Rowe et al. | |
| D340,812 | S | | 11/1993 | Estomin et al. | |
| 5,297,851 | A | * | 3/1994 | Van Hekken | 297/452.14 |
| 5,314,240 | A | * | 5/1994 | Ishi et al. | 297/452.21 X |
| D352,185 | S | | 11/1994 | Pagnon et al. | |
| D352,616 | S | | 11/1994 | Meyer | |
| D353,270 | S | | 12/1994 | Locher | |
| 5,383,712 | A | | 1/1995 | Perry | |
| 5,511,855 | A | | 4/1996 | Miles | |
| 5,575,534 | A | * | 11/1996 | Yu | 297/452.21 |
| 5,577,811 | A | * | 11/1996 | Ogg | 297/452.14 X |
| 5,599,068 | A | | 2/1997 | Kelly et al. | |
| 5,755,489 | A | * | 5/1998 | Rossman et al. | 297/452.21 X |
| 5,868,469 | A | | 2/1999 | Ming | |
| 5,887,951 | A | * | 3/1999 | Willingham | 297/452.23 |
| D408,660 | S | | 4/1999 | Donnelly | |
| D411,382 | S | | 6/1999 | Graham | |
| 5,924,770 | A | * | 7/1999 | Tarnay et al. | 297/452.14 X |
| 5,961,184 | A | * | 10/1999 | Balderi et al. | 297/448.1 |
| 5,997,094 | A | | 12/1999 | Cvek | |
| 6,003,948 | A | * | 12/1999 | Holbrook | 297/452.14 X |
| 6,017,089 | A | | 1/2000 | Mengshoel | |
| D423,805 | S | | 5/2000 | Olson | |
| 6,056,361 | A | | 5/2000 | Cvek | |
| D426,970 | S | | 6/2000 | Kolberg | |
| 6,082,824 | A | * | 7/2000 | Chow | 297/452.22 X |
| 6,109,696 | A | * | 8/2000 | Newhouse et al. | 297/452.14 X |
| D431,385 | S | | 10/2000 | Barile et al. | |
| 6,125,851 | A | | 10/2000 | Walker et al. | |
| D433,577 | S | | 11/2000 | Donnelly | |
| D433,578 | S | | 11/2000 | Saul | |
| D447,643 | S | | 9/2001 | Zemp | |
| D469,970 | S | | 2/2003 | Molteni | |
| 6,532,962 | B1 | | 3/2003 | Walker et al. | |
| 6,604,784 | B1 | * | 8/2003 | Bosman et al. | 297/448.2 X |
| 6,634,717 | B2 | * | 10/2003 | Kown | 297/452.14 X |
| D485,085 | S | | 1/2004 | Swy et al. | |
| 6,688,688 | B2 | | 2/2004 | Uhlenbrock | |
| 6,722,735 | B2 | | 4/2004 | Lucci et al. | |
| 6,726,285 | B2 | * | 4/2004 | Caruso et al. | 297/452.21 X |
| D502,030 | S | | 2/2005 | Barile, Sr. | |
| 6,863,349 | B2 | * | 3/2005 | Belic | 297/448.1 X |
| 2003/0090139 | A1 | | 5/2003 | Kown | |
| 2003/0227210 | A1 | | 12/2003 | Bosman et al. | |
| 2004/0104613 | A1 | | 6/2004 | Bosman et al. | |
| 2004/0251729 | A1 | * | 12/2004 | Olson | 297/452.14 |

FOREIGN PATENT DOCUMENTS

| | | | | | |
|---|---|---|---|---|---|
| JP | 05007517 | A | * | 1/1993 | 297/452.14 |
| JP | 06121720 | A | * | 5/1994 | 297/452.12 |
| JP | 2000-050137 | | | 2/2000 | |
| WO | WO9408491 | A1 | * | 4/1994 | 297/452.23 |

OTHER PUBLICATIONS

Comfor Tek Seating, Elan Series "Model ES122 Elan Stacker w/Tablet Arm".

Growth Chart for Chinese Children, www.fwcc.org/growthchart.html.

CDC Growth Chart: United States: Weight-for-age percentiles, Girls 2-20.

CDC Growth Chart: United States: Weight-for-age percentiles, Boys 2-20.

Clinical Growth Charts, National Center for Health Statistics, CDC.

University of Michigan Health System, Ideal Weight Table for Men and Women.

www.synapseadaptive.com/ergo/Thorsac.htm—The Two Part Seat and TherSac Advantage.

BIFMA International, "U.S. Economic Recovery Underway, Modest Office Furniture Industry Growth Expencted in 2004", News Release, Jan. 27, 2004.

Human ErgoSystems, Inc., "Ergonomics Review", Jun. 5, 2004.

Ergonomics Review of Sitting and Movements, Rani Lueder, CPE.

"Musculoskeletal Modeling As An Ergonomic Design Method", J. Rasmussen, et al., The AnyBody Group, Institute of Mechanical Engineering, Allborg University, Denmark.

"Mismatch Between Classroom Furniture Dimensions and Student Anthropometric Characteristics in Three New Zealand Secondary Schools", S.J. Legg, et al., Faculty of Health Sciences, Universal College of Learning, Palmerston North, New Zealand.

"Balanced sitting posture on forward sloping seat", A.C. Mandal, M.D., Copenhagen, www.acmandal.com.

"A Technique for Musicians", Frank Pierce Jones, www.alexandertechnique.com.

"The Life of Chairs: How Homo Sapiens became Homo Sedens-and at what cost", excerpt from E. Tenner, "Our Own Devices: Past and Future of Body Technology © 2002".

"New Concepts in Seating", J. Tiedeman, CSP, CIE, ARM, Ergonomics Consultant.

"The Alexander Technique for Musicians" C.J. Stein, www.alexandertechnique.com.

"The Alexander Technique in the world of design: posture and the common chair", G. Cranz; Journal of Bodywork and Movement Therapies, Apr. 2000.

"Bottoms Up", M. Downey, Ergonomics Center, News Story 193, May 22, 2002.

"Furniture prescription for the conservative management of low-back pain", E. Vollowitz, Topics in Acute Care and Trauma Rehabilitaiton, 1988:2(4):18-37, 188 Aspen Publishers, Inc.

"An Introduction to Body Mapping: Enhancing Musical Performance Through Somatic Pedagogy", H. Buchanan, On Voice, Choral Journal, vol. 45, Issue 7.

"Supporting the Biomechanics of Movement", The science and research bhind the Harmonic Tilt, H. Miller.

"The Art of Pressure Distribution", Ergonomic criteria for the design of adaptive suspension work chairs, H. Miller.
"Stressing Prevention", J. Horvath advocates for injured musicians; Green Room, Mar.-Apr. 2004.
"Seat Height Revisited", R. Lueder, Humanics ErgoSystems, Inc. Rethinking sitting height.
"A South Texas physician credits success to music", Idefonzo Flores, The Beat Goes On, Southwestern Musician, May 2005.
"Dynamic Task Posture for the Seated Musician", Jack Hockenberry, Wenger Corp., D. Zacharkow, Mayo Clinic.
"Harpist, Cellists, Short Musicians Unite!", J. Horvath, Minnesota Orchestra, 1997.
"Common Problems of Wind Instrumentalists", W. Dawson, Dec. 1977.
"Performance Injury Topic of Interest", N. Quarrier, PA Medicine Topic of Interest.
"Upper-extremety Problems Caused by Playing Specific Instruments", W. Dawson, Medical Problems of Performing Artists, Sep. 2002.
"Achieving a Healthier Relationship with your Flute", J. Lunn, Hands On! Newsletter, Issue #6.
"Medical Problems in Secondary School-aged Musicians", A. Lockwood, Dec. 1988.
"A Survey of Musculoskeletal Problems Encountered in High-Level Musicians", P. Caldon, L. Calabrese, J. Clough, R. Lederman, G. Williams, J. Leatherman, Medical Problems of Performing Artists, Dec. 1996.
"Health Conditions, Attitudes Toward Study, and Attitudes Toward Health at the Beginning of University Study: Music Students in Comparison with Other Student Populations", C. Spahn, S. Strukley, A. Lehmann, Medical Problems of Performing Artists, Mar. 2004.
"Muskuloskeletal Problems of Adolescent Instrumentalists", R. Manchester, Medical Problems of Performing Artists, Sep. 1997.
"Medical Problems of Brass Instrumentalists: Prevalence Rates for Trumpet, Trombone, French Horn and Low Bass", K. Chesky, K. Devroop, J. Ford, Medical Problems for Performing Artists, Jun. 2002.
"Medical Problems Among ICSOM Musicians: Overview of a National Survey", M. Fishbein, S. Middlestadt, V. Ottati, S. Straus, A. Ellis, Medical Problems for Performing Artists, Mar. 1988.
"Survey of Performance-related Problems among High School and Junior High School Musicians", D. Shoup, Medical Problems for Performing Artists, Sep. 1995.
"Fundamental Positions for Instrumental Musicians", R. Tubiana, P. Chamagne, R. Brockman, Medical Problems for Performing Artists, Jun. 1989.
"Medical Problems of Orchestral Musicians According to Age and Stage of Career", D. Smith, Medical Problems for Performing Artists, Dec. 1992.
"The Design of a Chair for Orchestral Musicians", G. Conchubhair, Department of Industrial Design, Dublin, Ireland.
"The Alexander Technique in the world of design: posture and the common chair", G. Cranz, Journal of Bodywork and Movement Therapies, Apr. 2000.
"Ergonomics of seated movement—a review of the scientific literature", R. Lueder, Humanics ErgoSystems, Inc., Jun. 2004.
"Preventing Musculoskeletal Injury (MSI) for Musicians and Dancers: A Resource Guide", Safety and Health in Arts Production and Entertainment, Jun. 2002.

* cited by examiner

MUSIC POSTURE CHAIRS

RELATED APPLICATIONS

This application claims the benefit of priority under U.S. Provisional Application Nos. 60/599,314 entitled "Music Posture Chairs" filed Aug. 5, 2004 and 60/649,196 entitled "Music Posture Chairs" filed Feb. 2, 2005. The disclosures of the aforementioned provisional applications are hereby incorporated by reference to the extent not inconsistent with the present disclosure.

FIELD OF THE INVENTION

The present invention relates generally to a chair for performers including musicians. The present invention also relates to a posture chair for a performer that encourages proper posture in an engaged as well as perch position. The present invention also relates to a chair having adjustable features that can enhance a musician's posture.

BACKGROUND OF THE INVENTION

For at least fifty years, it has been recognized that good posture enhances the performance of various activities. As a result, various products have been developed that enhance posture while performing various office, home and recreational activities.

For example, aeronautical and automotive seats have been developed that enable operators to comfortably operate their vehicles for extended periods of time. Spectator seating for cultural and sporting events have also been enhanced so that audiences can remain comfortably seated throughout the performances.

It can be appreciated that activities requiring higher levels of physical exertion have the potential of benefiting most from using equipment that promotes good posture as the posture tends to deteriorate as the body becomes more tired.

One particular field in which posture is particularly important is for seated musicians. String players need to sit erect to perform properly as do musicians such as vocalists or wind instrumentalists that require good breath support. However, in light of the limitations associated with most prior art seating for musicians, it is common for the musicians to stand or to sit near the front of a chair.

A drawback of these options is that it becomes difficult to remain sitting near the front of a chair throughout an entire concert or practice session. As a result of the strains placed on the body when performing while sitting on the front of the chair, the musician will typically be unable to maintain this position throughout the entire concert or practice session. When this occurs, the ability of the musician to remain focused on performing or practicing is greatly reduced.

One of the first attempts to produce a musicians' chair that promotes good posture while performing music is disclosed in Wenger et al., U.S. Pat. No. 4,306,750, which is assigned to the assignee of the present application. Other music chairs are described in U.S. Pat. No. 4,671,570 and in U.S. Design Pat. Nos. 264,779 and 297,890. U.S. Pat. Nos. 4,306,750 and 4,671,570, and U.S. Design Pat. 264,779 and 297,890 are all incorporated herein by reference. The Wenger et al. musicians' chair orients the seat back and seat pan to promote posture while performing music. While the Wenger chair has the potential of providing seated musicians with enhanced posture, this potential is only fully realized when the musician is properly seated in the Wenger chair (i.e. with their back in contact with the seat back and hips placed at the rear of the seat pan). Moreover, performers often sit in a forward (or "perch") position on the Wenger chair, whether from personal preference, due to encouragement from instructors or conductors or for other reasons. Therefore, a chair that is designed to encourage proper posture while a performer is seated with hips placed in the back of the seat pan or hips placed forward in a perch position is needed.

SUMMARY OF THE INVENTION

In one embodiment, the invention pertains to a music posture chair comprising a seat portion, a frame connected to the seat portion, a back portion connected to the seat portion, and an adjustable back supporting member operably connected to the frame that adjusts to a user's posture and can provide back support when the user is in a perched or forward leaning position as well as a rest position.

In another embodiment, the invention pertains to a music posture chair comprising a frame, a seat portion connected the frame, and an adjustable back portion connected to the seat portion that can be adjusted to support a user's back when the user is in perched or forward leaning position as well as a rest position.

In another embodiment, the invention pertains to a music posture chair comprising a frame, a seat and a back. The frame has a seat portion, a back portion, and a plurality of legs. The seat is operably attached to the seat portion, while the back is operably attached to the back portion. In these embodiments, the seat can move or tilt such that the chair can provide support in either a rest position or an alert position.

In another embodiment, the invention pertains to a music posture chair comprising a frame, a seat having a front section and a back section, and a back. In these embodiments, the seat and the back portions are attached to the frame. In these embodiments, the front section of the seat can be pivotally connected to the frame such that the front section can be pivoted to simulate an alert position, which facilitates supporting the user's back in the simulated alert position.

In another embodiment, the invention pertains to a music posture chair comprising a frame, a seat having a front section and a back section and a back. In these embodiments, the back section of the seat can move forward and upward to provide an elevated alert position having back support provided by the back portion.

In another embodiment, the invention pertains to a music posture chair comprising a frame, a seat portion connected to the fame and a back portion connected to the frame, wherein the back portion can move forward relative to the seat portion such that as the back portion moves forward, the front section of the seat portion tilts downward while the back section of the seat portion elevates.

In another embodiment, the invention pertains to a music posture chair comprising a base portion, a seat portion, a seat support that connects the seat portion to the base portion and a back portion operably attached to the seat portion. In these embodiments, the music posture chair can further comprise an elastomeric spring operably connected to the seat support, or to a frame, to facilitate flexing or moving the seat in desired directions during use of the chair. In some embodiments, the elastomeric spring can permit the seat to flex any direction within a circle (360 degrees).

In another embodiment, the invention pertains to a music posture chair comprising a frame, a seat portion connected to the frame, and a back portion connected to the frame, wherein the frame is adapted to allow a user to rock between a use position where the back section of the seat portion can be elevated and a rest position where the back section of the seat portion can be generally parallel to the ground. In other embodiments, as the chair is rocked from a rest position to a use position, the front portion of the seat can be lowered to provide a use position with desired back support.

In another embodiment, the invention pertains to a music posture chair comprising a frame, seat portion comprising a plurality of structures adapted to engage the frame, and a back portion comprising a plurality of structures adapted to engage the frame, wherein the plurality of structures on the seat portion and the plurality of structures on the back portion permit the user to adjust both the seat portion and the back portion to desired preferences.

In another embodiment, the invention pertains to a music posture chair comprising a frame, a seat portion connected to the frame and a back portion connected to the frame, wherein desired sections of the seat portion can comprise a cushioning agent to encourage a user to sit in the desired section of the seat during use of the chair. In some embodiments, the cushioning agent can be an elastomeric material such as a natural rubber, synthetic rubber, mesh material, foam material, air, gel, water or the like and combinations thereof.

In another embodiment, the invention pertains to a music posture chair comprising a frame, a seat portion connected to the frame and a back portion connected to the frame, wherein the back portion, the seat portion or both comprise a plurality of axially adjustable elements which can adjust and contour to the shape of a user's back and/or seat.

In another embodiment, the invention pertains to a music posture including a unique seat shape to facilitate good posture, wherein the height of back portion is adjustable. In these embodiments, the seat portion can include a downward sloping, or curved, portion that can facilitate good posture.

In another embodiment, the invention pertains to music posture chair including a back portion that can deflect or adjust to facilitate good posture by the individual using the chair. In these embodiments, the seat portion can comprise a seat portion including a downward sloping, or curved, portion that can facilitate good posture.

In another embodiment, the invention pertains to a music posture chair having a curvature to the seat/back portion that supports a user's lower back. In these embodiments, the seat/back portion can bend or adjust in response to positioning of the user.

In another embodiment, the invention pertains to a music posture chair including a foot ramp that aids in obtaining a desired spinal position when the user is seated on the chair.

In another embodiment, the invention pertains to a music posture chair having a cantilever design that facilitates height adjustment of the chair.

The chairs in each of the embodiments set forth hereinabove may be constructed to be light in weight. In addition, the chairs may be constructed to allow for stacking of similarly constructed chairs.

BRIEF DESCRIPTION OF THE FIGURES

As shown in FIG. 6, the connection between the front section and the back section can form a "pinch point" and be a source of potential injury. Mechanisms for construction of such a connection to eliminate or to keep the "pinch point" from being accessible to a user are contemplated.

FIG. 7*a* shows the front section of the seat portion pivoted in a downward direction while FIG. 7*b* shows the front section of the seat portion aligned with the back section.

FIG. 11*a* shows a forward tilt/perched position and FIG. 11*b* shows a rearward position.

DETAILED DESCRIPTION OF THE INVENTION

Improved music posture chairs can comprise adjustable structure such as, for example, adjustable back portions, adjustable seat portions, adjustable legs and combinations thereof, which permits the improved chairs to adjust such that desired posture, support and height of a musician seated in the chair can be maintained during a musical performance and/or practice session. More specifically, the music posture chairs of the present disclosure can adjust, or move, such that proper posture and support can be maintained when the musician is in a resting position (i.e. leaning back) and when the musician is in a perched or playing position (i.e. leaning forward). Additionally, the chairs of the present disclosure may allow a performer to perform in either a perched or an engaged position.

Generally, the improved music posture chairs comprise a frame, a seat connected to the frame and a back connected to either the frame or the seat. In some embodiments, the seat portions can be uniquely contoured to provide comfort and spinal alignment for a variety of postural deviations that can result from the particular instrument the user is playing while seated in the chair. In some embodiments, the adjustable structure can comprise an adjustable back portion, an adjustable arm portion, an adjustable seat, adjustable legs or combinations thereof. In other embodiments, the improved chairs can be designed such that seat, legs, and/or the back can be adjustable and/or interchangeable, which permits the user to "customize" the chair to provide desired support and posture for the particular user. Additionally, in some embodiments, the back portion and/or the seat portion of the chairs can comprise a plurality of axially adjustable elements that can contour to the shape of a musician's back and/or seat. In further embodiments, a portion of the seat can comprise a cushioning element, which can encourage a user to sit in a desired location on the chair.

As used herein, the terms "seat", "seat portion" and "seat pan" are used interchangeably.

As used herein, the terms "back", "back portion" and "seat back" are used interchangeably.

As used herein, "engaged" means a position in which the user of a chair is seated n the seat pan and is in contact with the seat back.

As used herein, "perch" or "perched" is used to refer to a position in which the user of a chair has moved forward from an engaged position and is no longer in contact with the back of the chair.

Figure 1A:
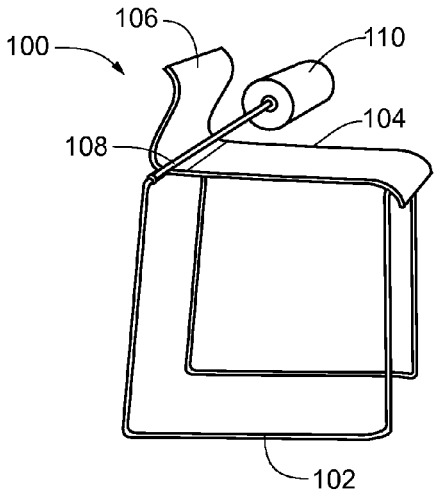
FIG. 1*a* is a side perspective view of a music posture chair having an adjustable arm pivotally connected to a frame, the adjustable arm shown in a forward position.
Figure 1B:
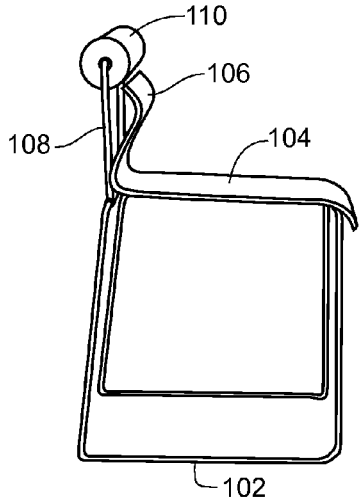
FIG. 1*b* is a side perspective view of the music posture chair of FIG. 1*a* with the adjustable arm shown in a back position.
Figure 1C:
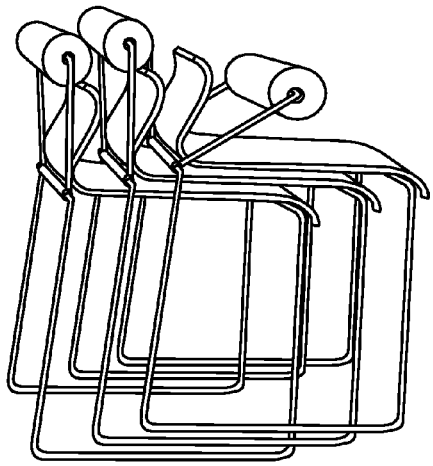
FIG. 1*c* is a side perspective view of a plurality of the music posture chairs of FIGS. 1*a* and 1*b* stacked together.

Referring to FIGS. 1*a-c*, a music posture chair 100 is shown comprising frame 102, seat 104 connected to frame 102 and back 106 connected to seat 104. Back 106 may be formed integrally with seat 104. Back 106 may be designed to contact the user at or about the region between the lumbar and sacral vertebrae. Frame 102 can be adapted to support seat 104 and to provide legs for chair 100.

In some embodiments, adjustable arm 108 can be pivotally connected to frame 102 such that adjustable arm 108 can be moved from a front position shown in FIG. 1*a* to a back position shown in FIG. 1*b*. In other embodiments, adjustable arm 108 can also move in a side-to-side manner to provide support to a user's back during use of chair 100. In some embodiments, adjustable arm 108 can comprise back pad 110, which can be a foam pad, elastomeric pad, or the like. In some embodiments, adjustable arm 108 can be biased towards the forward position by, for example, a spring to contact the lumbar/sacral region of the spine of a musician seated in chair 100, if the musician is in a perched, or forward leaning, position and the upper lumbar/lower thoracic region of the spine if the musician is seated all the way back on the chair. As shown in FIG. 1*b*, back 106 may be relatively shorter than most chair back and may allow back pad 110 to pass above the top of back 106 as adjustable arm approaches an angle that is perpendicular to the surface on which chair 100 is place.

As a musician seated in chair 100 leans backwards, adjustable arm 108 can move, or pivot, from the position show in FIG. 1*a*, to the position shown in FIG. 1*b*. Adjustable arm 108, and back pad 110 permit proper posture and back support to be maintained as a musician moves from a resting position to a perched, or active, position. As shown in FIG. 1*c*, chair 100 may be stacked with other chairs of the same construction with adjustable arm 108 and back pad 110 each chair being capable of being urged back as chairs are added thereby allowing stacking to continue.

Chair 100 may also be constructed to allow a user to perform while seated in the engaged position. In this configuration, back 106 and back pad 110 would contact the spinal region of the user to induce a proper lordotic curve along the lumbar vertebrae, such as by contact in the lumbar region of the use or by contact at the sacrum or lumbar/sacral transition of the spinal region.

Figure 2C:
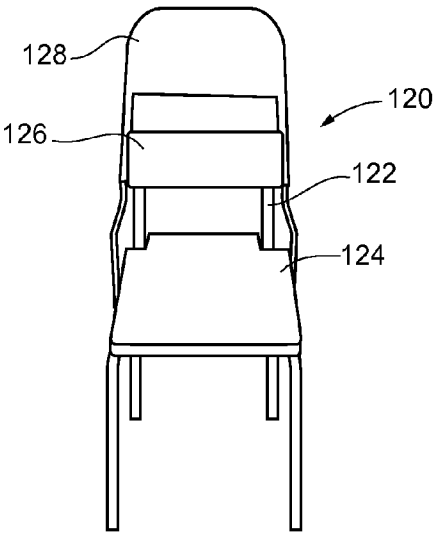
FIG. 2*c* is a front perspective view of the music posture chair of FIGS. 2*a* and 2*b*.
Figure 2B:
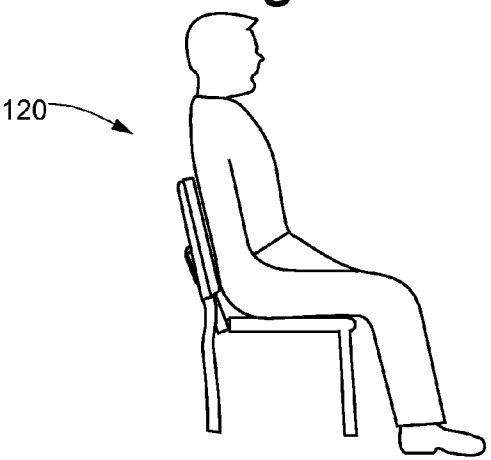
FIGS. 2*a* and 2*b* are side perspective views of an alternative embodiment of a music posture chair having an adjustable arm pivotally connected to the frame.
Figure 2A:
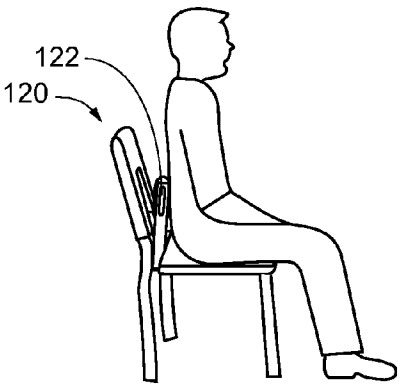

FIGS. 2*a-c* shows an alternative design of music posture chair 120 comprising adjustable arm 122 pivotally connected to frame 124. In some embodiments, back pad 126 can be provided on adjustable arm 122. As shown in FIG. 2*a*, the user is positioned in perched position and adjustable arm 122 is in a forward position contacting and supporting the user's back, while FIG. 2*b* shows the user in a resting position with adjustable arm moved to a back position. As shown in FIG. 2*c*, back 128 may be positioned to contact the lower to mid thoracic portions of the user's spinal region and therefore back pad 126 would be located below back 128 when the user is in the engaged position.

Figure 3C:
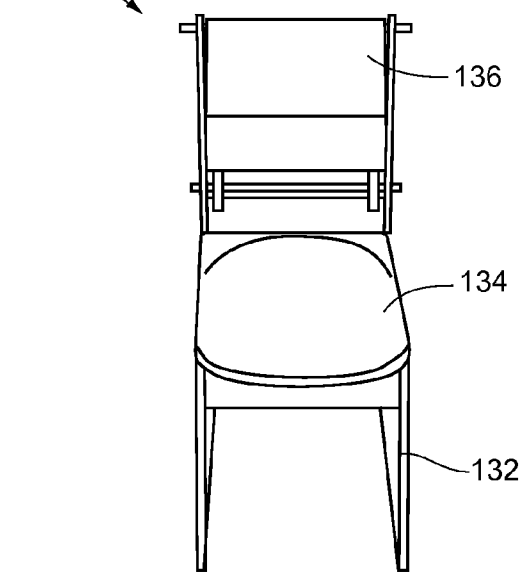
FIG. 3*c* is a front perspective view of the chair of FIGS. 3*a* and 3*b*.
Figure 3A:
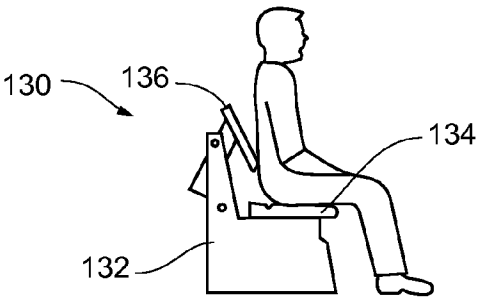
FIGS. 3*a* and 3*b* are side perspective views of an embodiment of a music posture chair having a back pivotally connected to a frame.
Figure 3B:
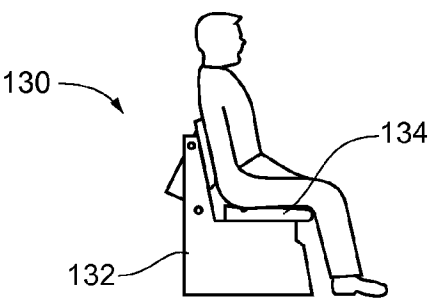

Referring to FIG. 3*a*-3*c*, a music posture chair 130 is shown comprising frame 132, seat 134 connected to frame 132, and back 136 pivotally connected to frame 132. In some embodiments, back 136 can be connected to a spring such that back 136 is biased towards the position shown in FIG. 3*a*. In these embodiments, as a user leans back into chair 130, back 136 can move from the position shown in FIG. 3*a* to the position shown in 3*b*. Biasing back 136 towards a front position shown in FIG. 3*a* facilitates supporting a user's back when the user is in a perched, or playing, position.

Figure 4A:
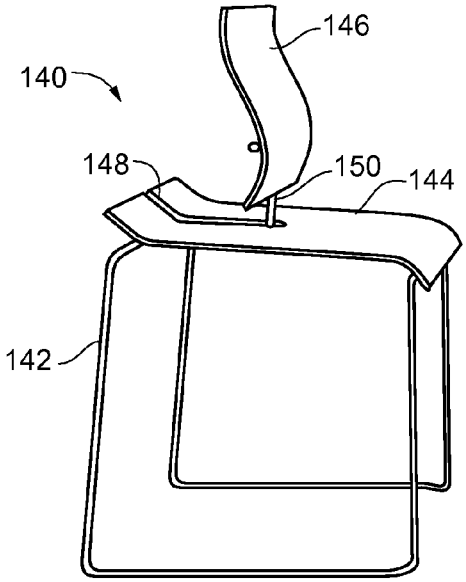
FIG. 4*a* is a side perspective view of a music posture chair having an adjustable back section where the adjustable back section is in a forward position.
Figure 4B:
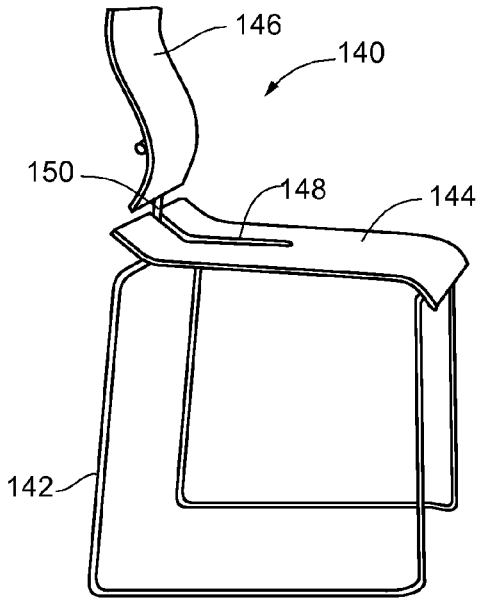
FIG. 4*b* is a side perspective view of the music posture chair of FIG. 4*a* where the adjustable back section is in a back position.

Referring to FIGS. 4*a* and 4*b*, a music posture chair 140 is shown comprising frame 142, seat portion 144 connected to frame 142, and adjustable back portion 146 connected to seat portion 144 by back support 150. In some embodiment, seat portion 144 can comprise a channel 148, which can be adapted to engage back support 150 such that back support 150 can be moved through channel 148.

Figure 4C:
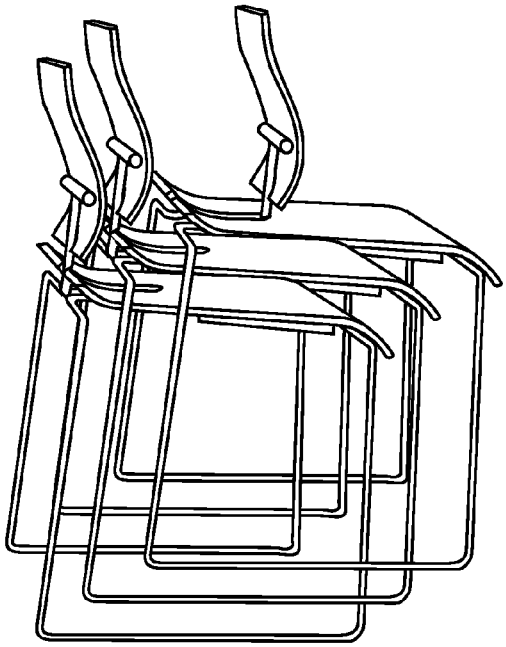
FIG. 4*c* is a side perspective view of a plurality of the music posture chairs of FIG. 4*a* stacked together.

Moving back support 150 through channel 148 permits adjusting the position of back portion 146 relative to seat portion 144. Back portion 146 is shown positioned in a front position in FIG. 4*a*, and in a back position in FIG. 4*b*. In some embodiments, back portion 146 can be tensioned by, for example, a spring or the like to move from the back to the front position as the user leans forward or moves to a perch position. Chair 140 may be constructed in a manner that allows for stacking of multiple chairs. As shown in FIG. 4*c*, back support 150 of a chair at the beginning or top of a stack may engage seat portion 142 of the chair being added to the stack and urged through channel 148 to a position allowing seat portions of adjacent chairs in the stack to nestle closer thereby reducing the height of the stack and allowing more chairs to be added to a stack.

Figure 5C:
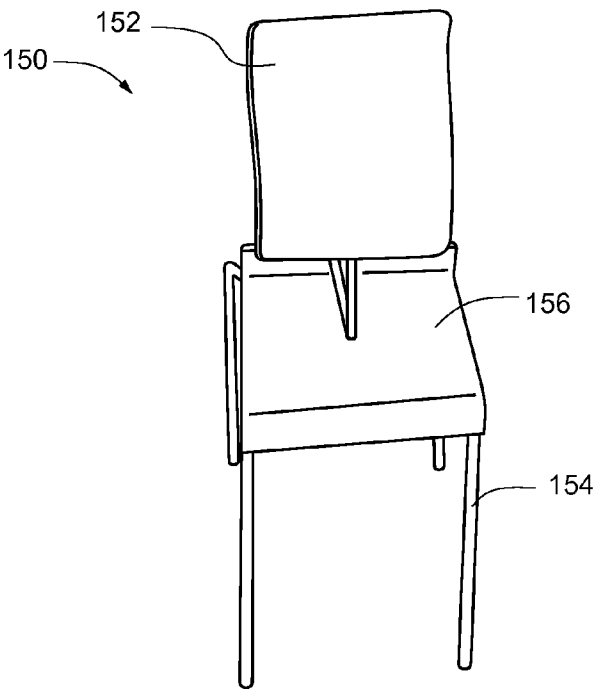
FIGS. 5*c* is a front perspective view of the music posture chair of FIGS. 5*a* and 5*b*.
Figure 5A:
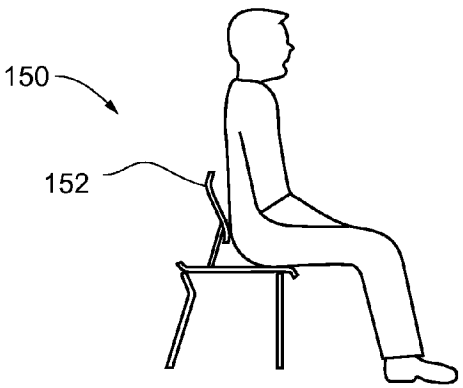
FIGS. 5*a* and 5*b* are side perspective views of an alternate embodiment of a music posture chair having an adjustable back section.
Figure 5B:
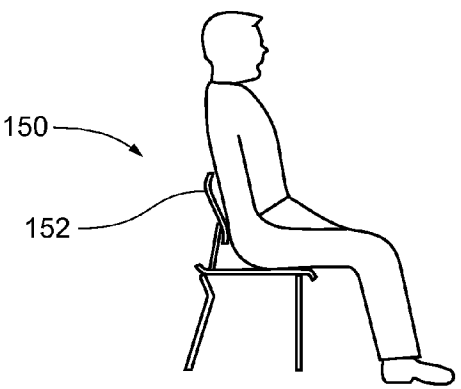

Referring to FIGS. 5*a-c*, an alternate embodiment of a music posture chair 150 is shown comprising an adjustable back portion 152. As shown in FIGS. 5*a-*5*c*, frame 154 can have a different shape than frame 142 of FIGS. 4*a-*4*c* and have four legs capable of independently contacting the ground. In these embodiments, frame 154 can be connected to seat portion 156, and back portion 152 can be operably connected to seat portion 156 such that back portion 152 can move relative to seat portion 156. In some embodiments, back portion 152 can be tensioned to move forward as a user moves forward in the chair. FIG. 5*a* shows a user sitting in chair 150 with back portion 152 in a forward position, while FIG. 5*b* shows the user sitting farther back in chair 150 and back portion 152 moved into a back position. Back portions 152, 142 may be constructed of varying heights to accommodate different size users and to provide varying degrees of support along the back of the performer.

Figure 6:
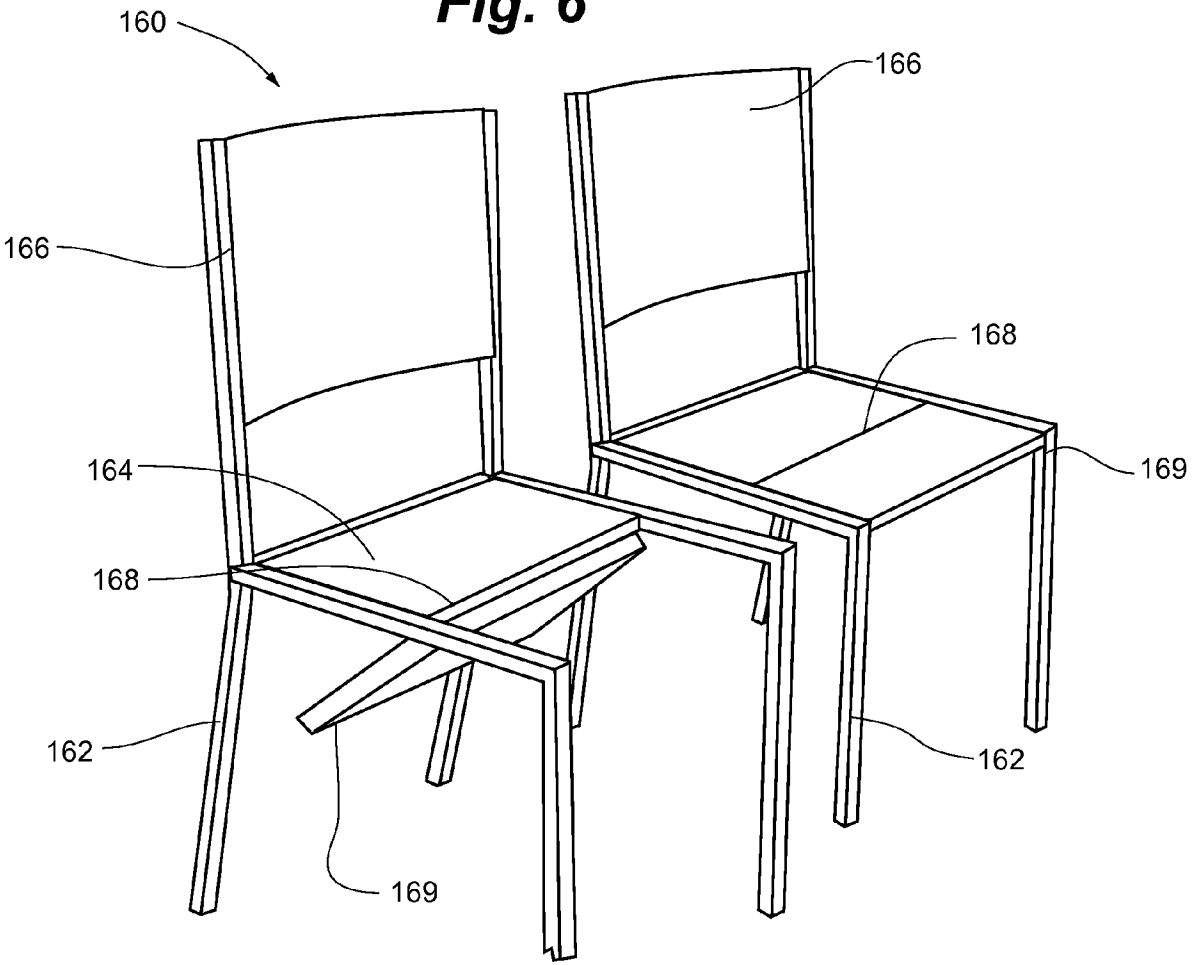
FIG. 6 is a perspective view of a music posture chair having a seat portion comprising a front section pivotally connected to a back section such that the front section can be pivoted in a downward direction to reduce the size of seat portion.
Figure 7C:
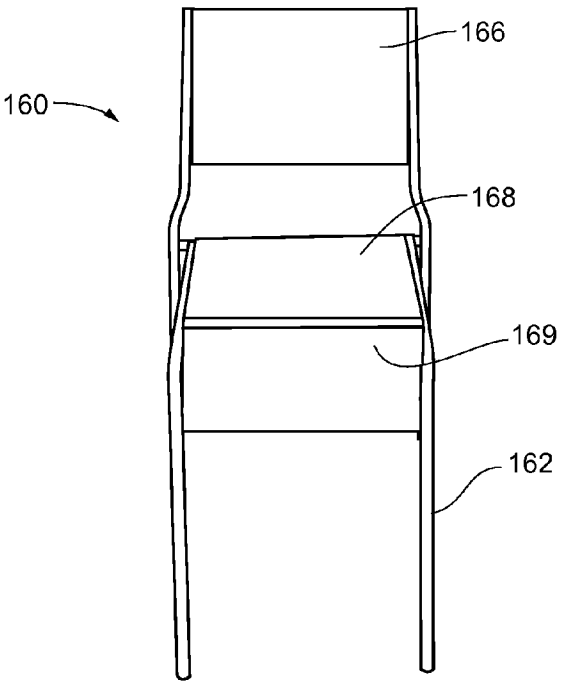
FIG. 7*c* is a front perspective view of the music posture chair of FIG. 6 with the front section of the seat portion aligned with the back portion.
Figure 7A:
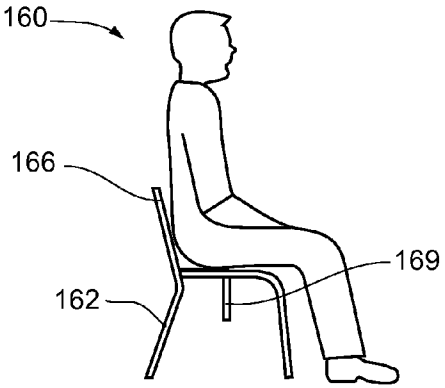
FIGS. 7*a* and 7*b* show a user seated in the music posture chair of FIG. 6 where

Referring to FIG. 6 and FIGS. 7*a-*7*c*, a music posture chair 160 is shown comprising frame 162, seat portion 164 connected to frame 162 and back portion 166 connected to frame 162. In these embodiments, seat portion 164 can comprise a back section 168 and a front section 169, wherein front section 169 can be pivotally connected to back section 168 such that front portion 169 can be pivoted in a downward direction leaving a reduced seat portion that can simulate an alert or perch position.

Figure 7B:
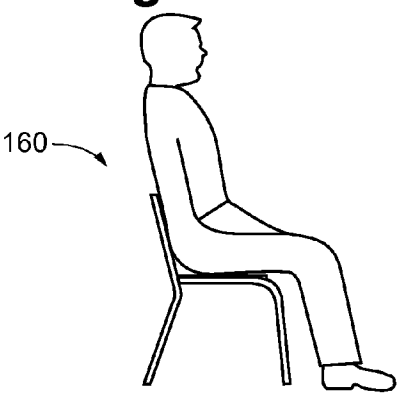

Since the user does not have to lean or slide forward away from back portion 166, pivoting front portion 169 down facilitates an alert position that has desired back support provided by back portion 166. The chair in the left side of FIG. 6 shows front section 169 pivoted into a down position, while the chair on the right side shows front section 169 aligned with back section 168. Additionally, FIG. 7*a* shows a user seated in music posture chair 160 with front section 169 pivoted into a down position, while FIG. 7*b* shows a user seated in chair 160 with front section 169 aligned with back section 168. Various locking mechanisms may be used to keep front section 169 of seat 164 in place. The strength of such locking mechanisms must take into account the possibility of a user sitting in a true perch position of the chair and thus applying substantial downward force upon front section 169 that must be supported by such locking mechanism.

Figure 8:
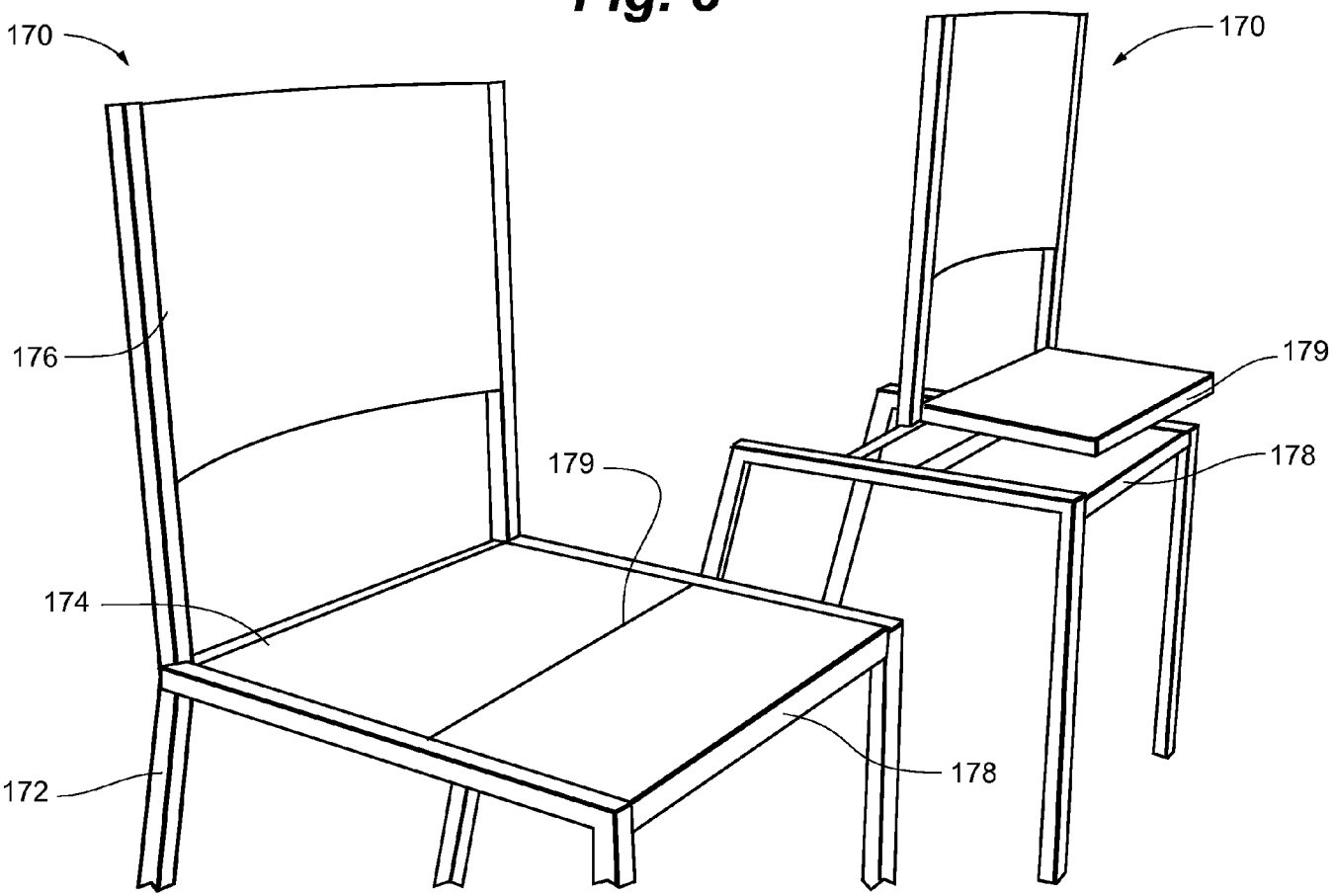
FIG. 8 is a perspective view of a music posture chair having a seat portion comprising a front section and a back section, wherein the back section can be moved in a forward and upward direction relative to front section to provide an elevated alert position with a back support.

Referring to FIG. 8, a music posture chair 170 is shown comprising frame 172, seat portion 174 connected to frame 172, and back portion 176 connected to frame 172. In some embodiments, seat portion can comprise a front section 178 and back section 179, wherein back section 179 can be hingedly coupled to frame 172 such that back section 179 and back portion 176 can be moved in a forward and upward direction relative to front section 178, which can provide an elevated alert position with desired back support. The chair on the right side of FIG. 8 shows back portion 179 moved into an elevated and forward position relative to front section 178, while the chair on the left side of FIG. 8 shows back portion 179 substantially aligned with front portion 179.

Figure 9:
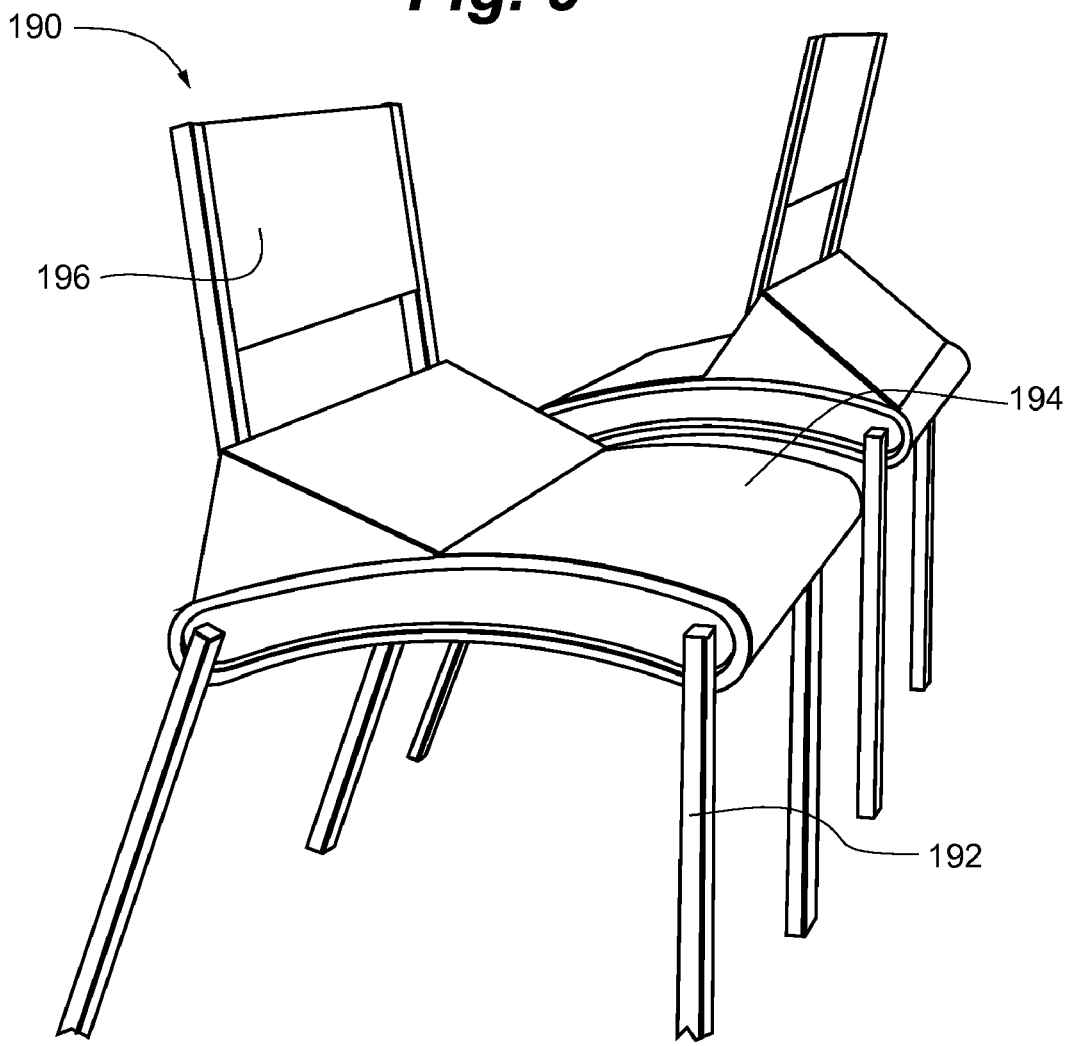
FIG. 9 is a side perspective view of a music posture chair comprising a frame, a seat portion connected to the frame and a back portion connected to the frame, wherein the seat portion and/or the back portion can slide forward long the frame to provide support in both a use position and rest position.
Figure 10C:
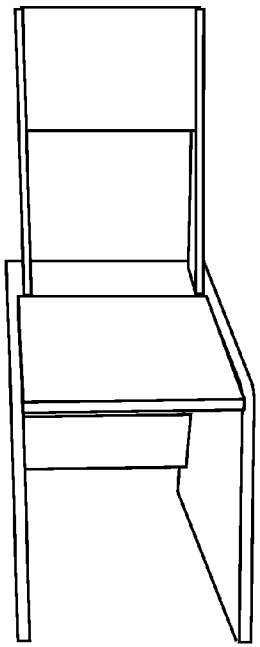
FIG. 10*c* is a front perspective view of the music posture chairs of FIGS. 10*a* and 10*b*.
Figure 10A:
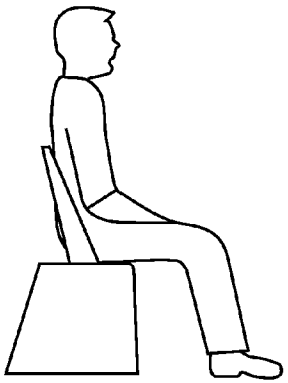
FIG. 10*a* is a side perspective view of an alternate embodiment of the music posture chair of FIG. 9 with the chair shown in the use position.
Figure 10B:
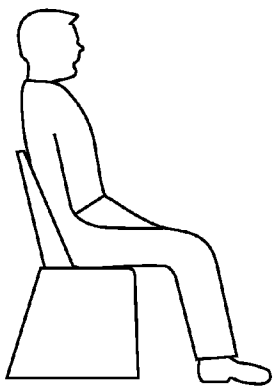
FIG. 10*b* is a side perspective view of an alternate embodiment of the music posture chair of FIG. 9 with the chair shown in the rest position.
Figure 10F:
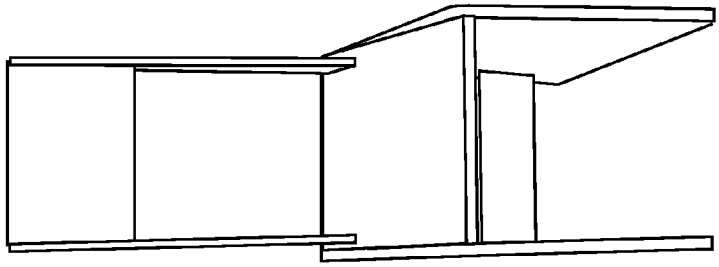
FIG. 10*f* is a front perspective view of the chair of FIGS. 10*d* and 10*e*.
Figure 10D:
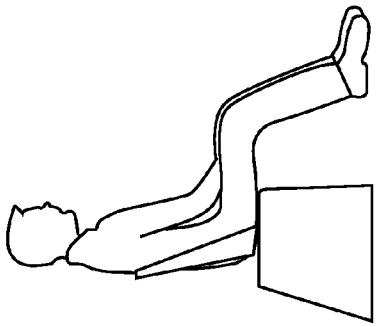
FIGS. 10*d* and 10*e* are side perspective views of an alternate embodiment of the chair of FIGS. 10*a* and 10*b*, wherein the seat can move forward and tilt simultaneously to create a forward use position.
Figure 10E:
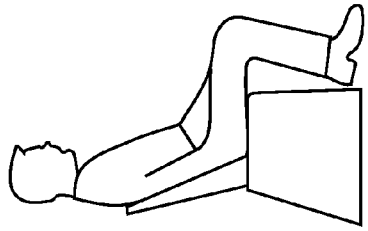

Referring to FIG. 9, a music posture chair 190 is shown comprising a frame 192, a seat portion 194 connected to frame 192 and back portion 196 connected to frame 192. In these embodiments, back portion 196 and/or seat portion 194 can slide forward such that chair 190 can provide support in a rest or engaged position, shown in FIG. 10*b*, or a use or perched position, shown in FIG. 10*a*. FIGS. 10*a-f* show an alternative embodiment of the music posture chair of FIG. 9 having an alternate frame design. In some embodiments, as shown in FIGS. 10*d-f*, the seat portion can tilt into a use position as the seat is moving forward.

Figure 11A:
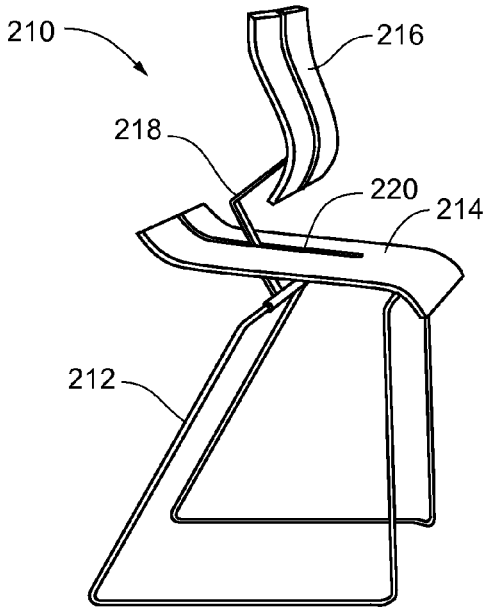
FIGS. 11*a* and 11*b* are side perspective views of a music posture chair that can move from a rearward position to a forward tilt/perched position, where

Referring to FIGS. 11*a-*11*c*, a music posture chair 210 is shown comprising frame 212, seat portion 214 connected to frame 212 and back portion 216 connected to frame 212 by arm 218. In some embodiments, seat portion 214 can be provided with channel 220, which is adapted to engage arm 218 such that arm 218 can slide within channel 220.

As arm 218 slides forward through channel 220, back portion 216 is moved in a forward direction relative to seat portion 214. Additionally, since arm 218 is connected to frame 212, moving arm 218 in a forward direction through channel 220 can cause seat portion 214 to move away from frame 212 such that back section of seat portion 214 can be elevated. In other words, the back portion 216 can move forward and seat portion 214 can elevate simultaneously to create a forward tilt/perched position.

Figure 11B:
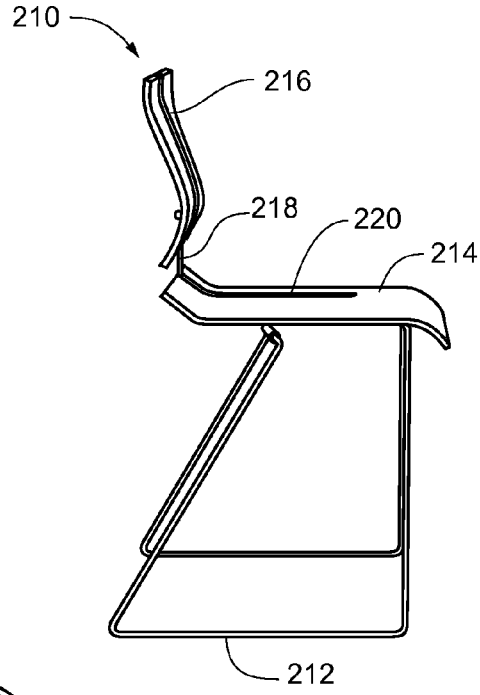
Figure 11C:
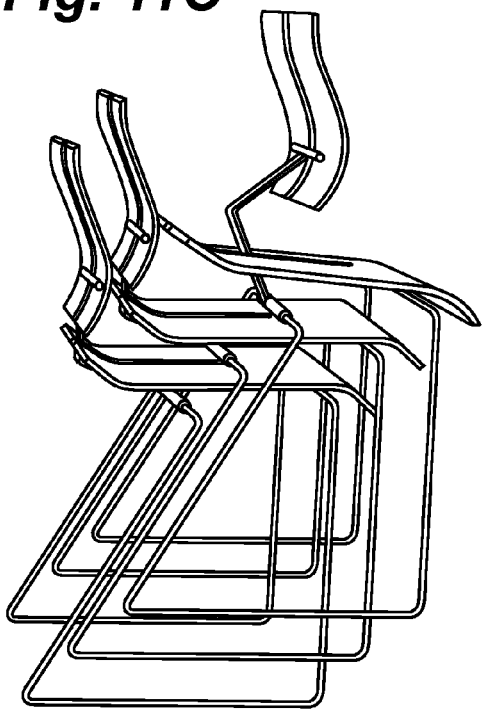
FIG. 11*c* is a side perspective view of a plurality of the chairs of FIGS. 11*a* and 11*b* stacked together.

Additionally, back portion 216 can be moved in a backwards direction and seat portion 214 can simultaneously lower to create a rearward reclining position. The forward tilt/perched position is shown in FIG. 11*a*, while the rearward position is shown in FIG. 11*b*.

Figure 12C:
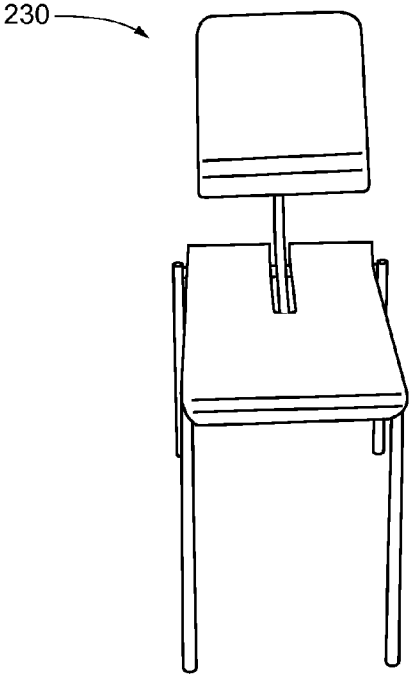
FIG. 12*c* is a front perspective view of the chair of FIGS. 12*a* and 12*b*.
Figure 12A:
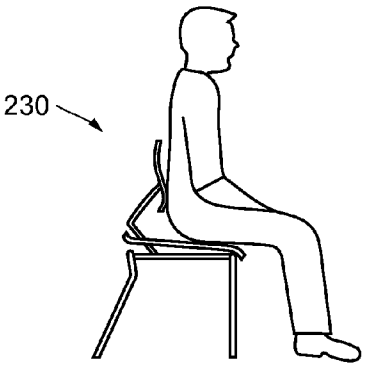
FIGS. 12*a* and 12*b* are side perspective views of an alternate embodiment of a music posture chair that can move from a forward tilt/perched position to a rearward position, with FIG. 12*a* showing a forward tilt/perched position and FIG. 12*b* showing a rearward position.
Figure 12B:
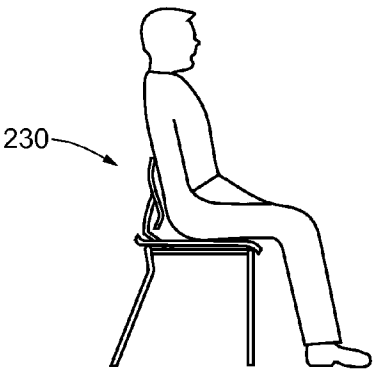

Referring to FIGS. 12*a-c*, an alternate music posture chair 230 is shown. Chair 230 is similar to chair 210 shown in FIGS. 11*a-*11*c*, except that chair 230 has a different frame design. FIG. 12*a* shows chair 230 positioned in a forward tilt/perched position where the back portion is moved forward and the seat portion elevated away from the frame. FIG. 12*b* shows chair 230 positioned in a rearward reclining position with the back portion in a back position and seat portion in a lowered position.

Figure 13A:
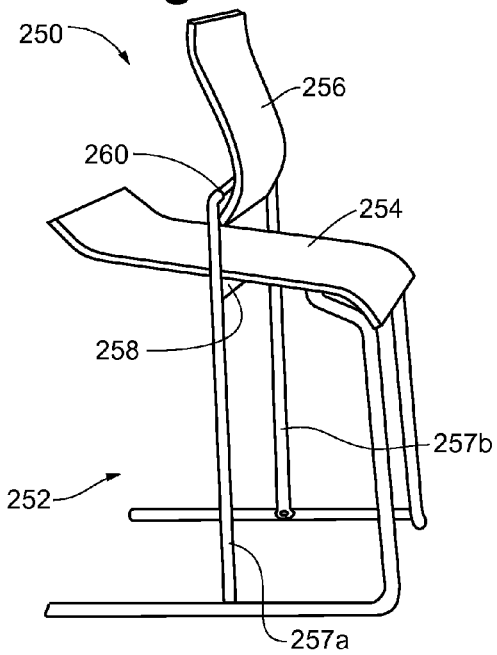
FIGS. 13*a* and 13*b* are side perspective views of a music posture chair comprising a frame, a seat portion connected to the frame and a back portion connected to the frame, wherein the back and seat can move synchronously to create a forward tilt/perch position and a rearward tilt/rest position.
Figure 13B:
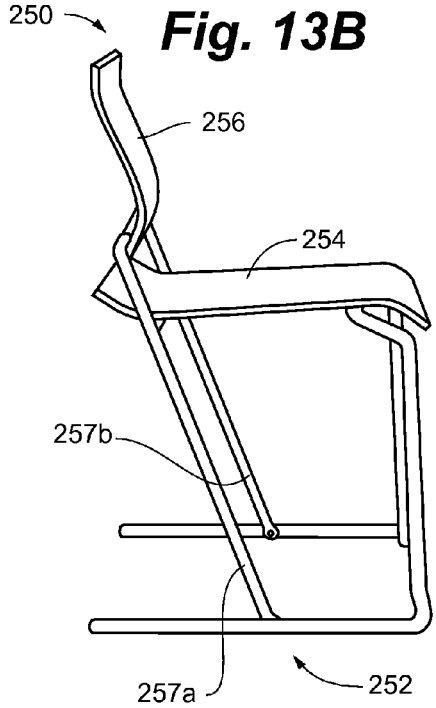
Figure 13C:
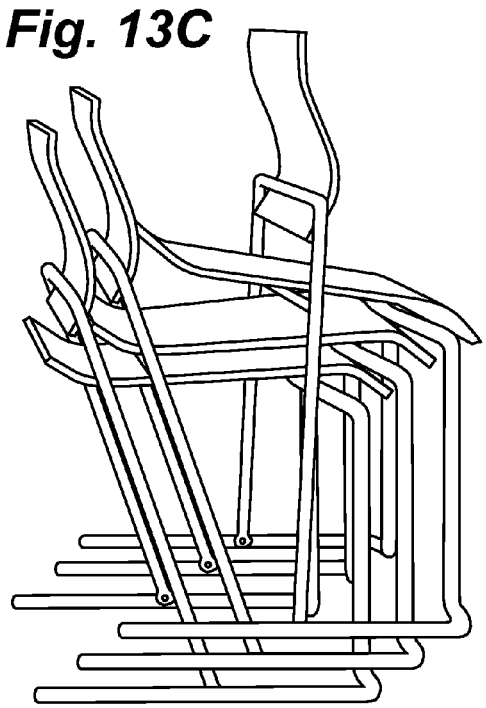
FIG. 13*c* is a side perspective view of a plurality of chairs of FIGS. 13*a* and 13*b* stacked together.

Referring to FIGS. 13*a* and 13*b*, a music posture chair 250 is shown comprising frame 252, seat portion 254 connected to fame 252 and back portion 256 connected to frame 252. As shown in FIG. 13*a*, frame 252 can comprise support bars 257*a* and 257*b*, cross bar 258 that supports seat portion 254 and cross bar 260 that supports back portion 256. Cross bars 258, 260 connect support bars 257*a* and 257*b*. Support bars 257*a* and 257*b* can move forward and backward, which can move attached cross bars 258, 260.

As support bars 257*a* and 257*b* are moved in a forward direction, back portion 256 can move forward and seat portion 254 can move upward to a forward tilt/perch position shown in FIG. 13*a*. Similarly, as support bars 257*a* and 257*b* are moved in a backwards direction, back portion 256 can move backwards and seat portion 254 can lower to a rearward tilt/rest position shown in FIG. 13*b*.

Figure 14C:
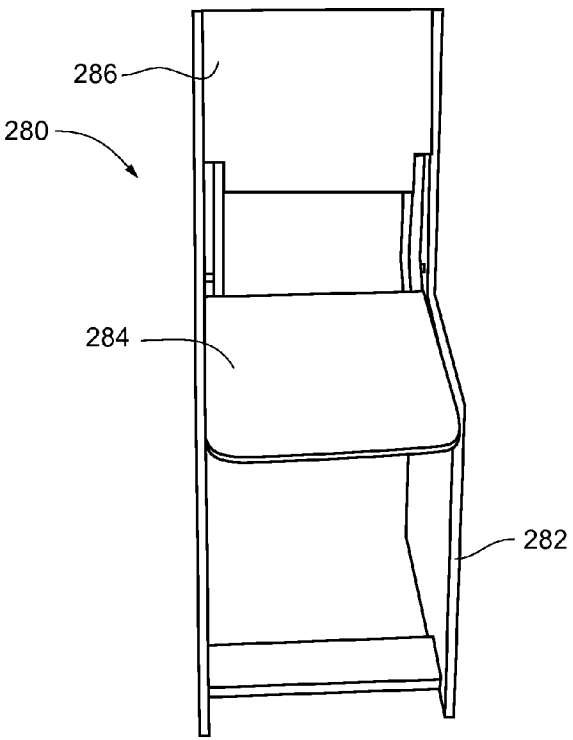
FIG. 14*c* is a front perspective view of the music posture chair of FIGS. 14*a* and 14*b*.
Figure 14A:
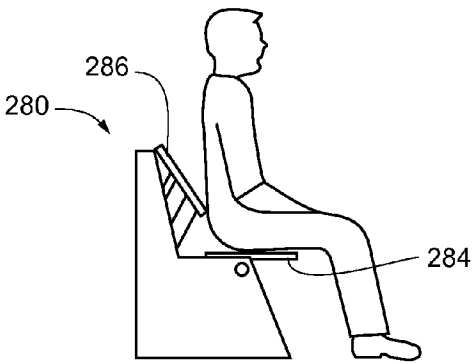
FIGS. 14*a* and 14*b* are side perspective view of a music posture chair having a back portion and a seat portion that can move from a rest position to a use position.
Figure 14B:
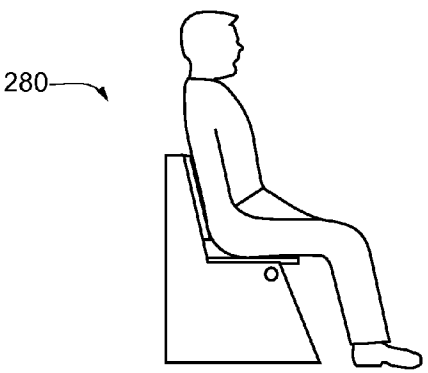

Referring to FIGS. 14*a-c*, a music posture chair 280 comprising frame 282, seat portion 284 and back portion 286, wherein back portion 286 and seat portion 284 are connected to and supported by frame 282. In these embodiments, back portion 286 can be pivotally coupled to frame 282 such that back portion 286 can pivot from a forward position shown in FIG. 14*a* to a backward position shown in FIG. 14*b*. Additionally, as back portion 286 moves forward toward the position shown in FIG. 14*a*, seat portion 284 can angle downward. This provides a forward perched position with desired back support.

Figure 15A:
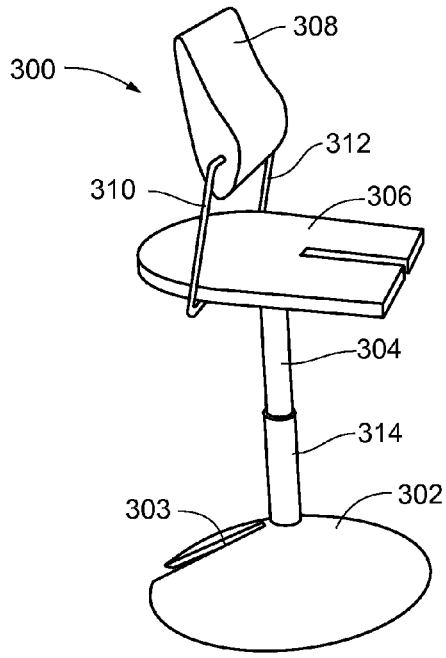
FIGS. 15*a* and 15*b* are side perspective views of a music posture chair comprising an elastomeric spring that can permit the seat to flex within 360 degrees.
Figure 15B:
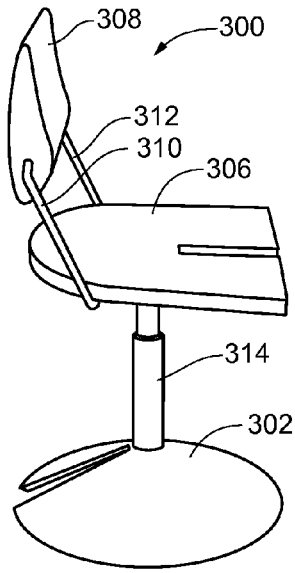
Figure 15C:
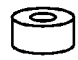
FIG. 15*c* is a perspective view of a section of an electrometric spring that can be used in the music posture chair of FIGS. 15*a* and 15*b*.
Figure 15D:
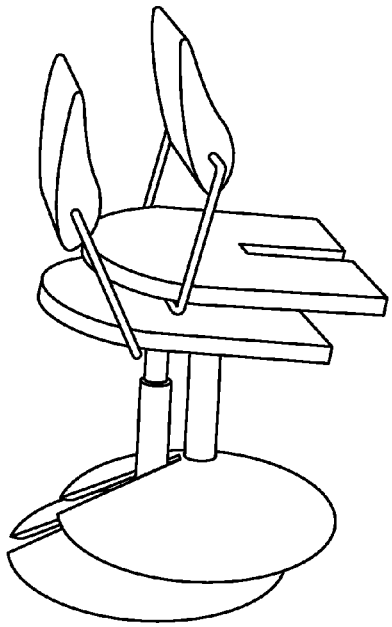
FIG. 15*d* is a perspective view of a seat portion that can be used in the music posture chair of FIGS. 15*a* and 15*b*.
Figure 15E:
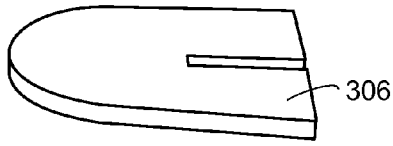
FIG. 15*e* is a side perspective view of a plurality of the music posture chairs of FIGS. 15*a* and 15*b* stacked together.
Figure 16C:
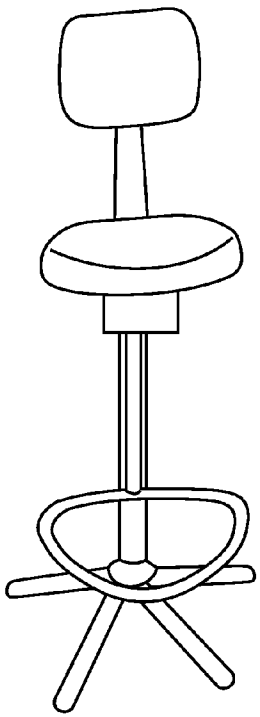
FIG. 16*a-c* shows an alternative embodiment of a music posture chair comprising an elastomeric doughnut that permit's the chair to move with the occupant.
Figure 16A:
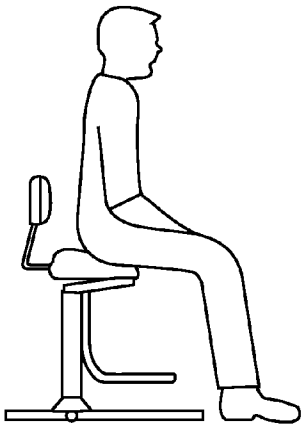
Figure 16B:
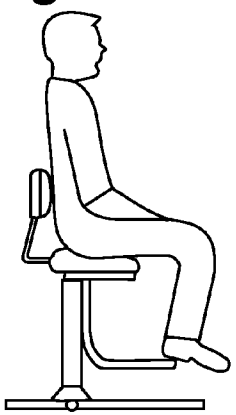

Referring to FIG. 15*a* and FIG. 15*b*, a music posture chair 300 is shown comprising base 302, support 304 connected to base 302, seat portion 306 connected to support 304, and back portion 308 connected to seat portion 306 by arms 310, 312. Base portion 302 can comprise channel 303, which can facilitate stacking of the music chairs for storage or the like. Additionally, an electrometric spring 314 can be provided on support 304, which permits seat 306 to flex within 360 degrees. In general, the amount and bias of flex can be controlled by the shape of spring 314. FIGS. 16*a-c* show an alternative embodiment of a music posture chair having an electrometric spring or doughnut that permit's the seat to move with the occupant. Elastomeric spring or doughnut 314 can provide greater flexibility and adjustability in the tilt/angle of seat 306.

Figure 17A:
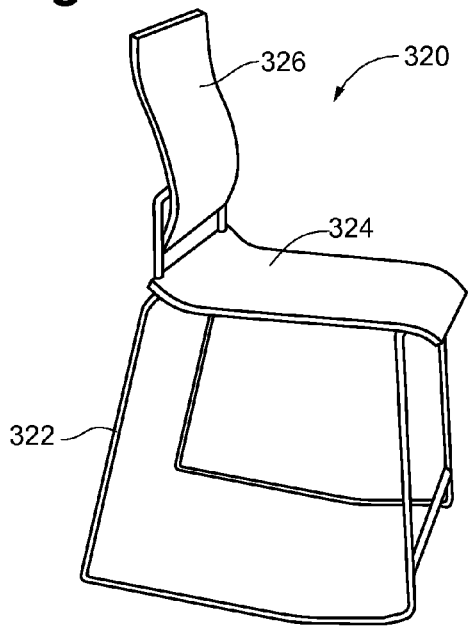
FIGS. 17*a* and 17*b* are side perspective views of a music posture chair that can rock from a use position to a rest position.
Figure 17B:
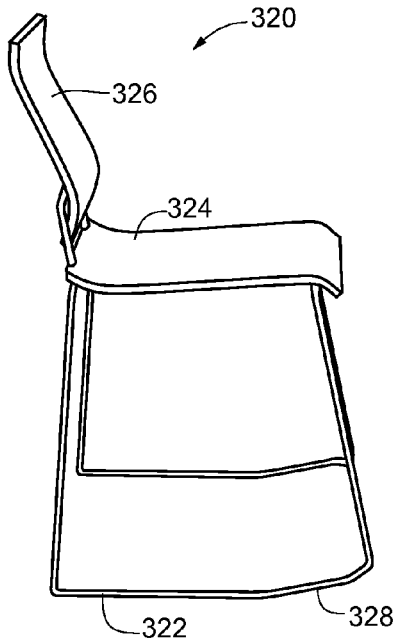
Figure 17C:
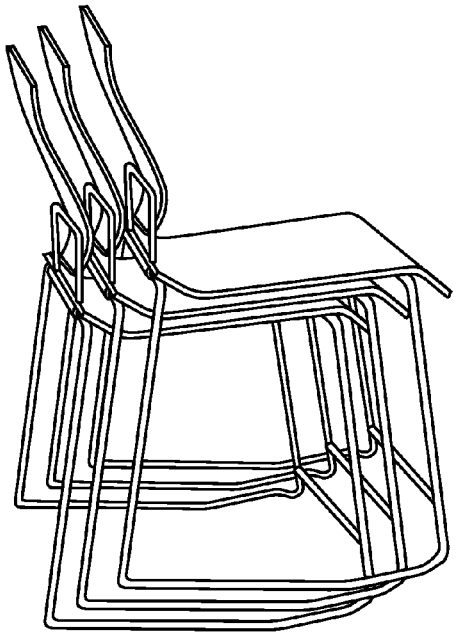
FIG. 17*c* is a side perspective view of a plurality of chairs of FIGS. 17*a* and 17*b* stacked together.
Figure 18C:
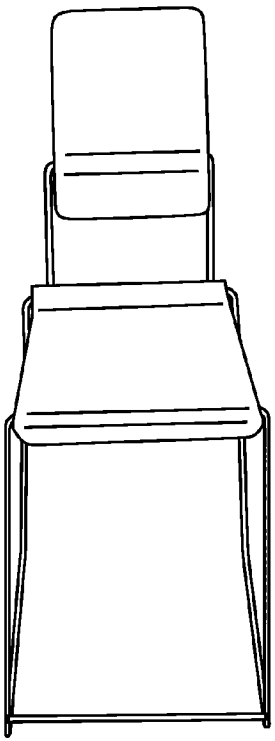
FIG. 18*c* is front perspective view of the music posture chair of FIGS. 17*a* and 17*b*.
Figure 18A:
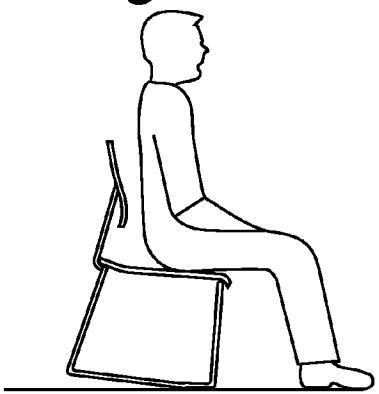
FIG. 18*a* is a side perspective view of the chair of FIGS. 17*a* and 17*b* shown in the use or forward position.
Figure 18B:
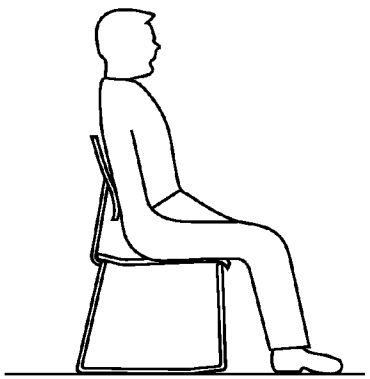
FIG. 18*b* is a side perspective view of the chair of FIGS. 17*a* and 17*b* shown in the rest or back position.
Figure 19A:
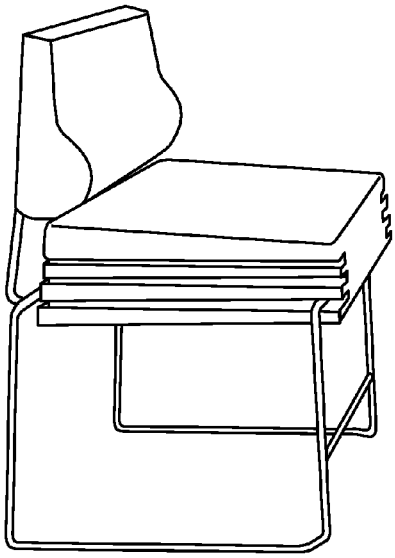
FIGS. 19*a* and 19*b* are perspective side views of a music posture chair having an adjustable seat and an adjustable back achieved through the use seats and backs constructed as cassettes that may be installed on the frame at different positions.
Figure 19B:
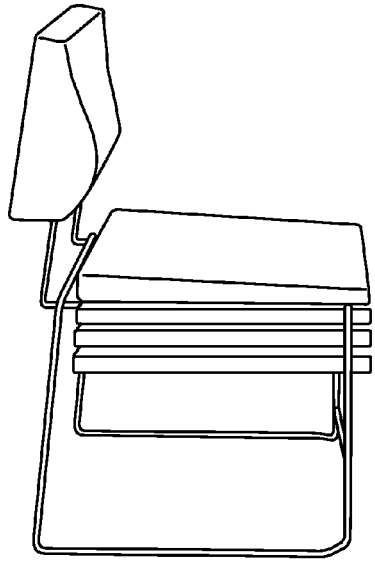
Figure 19C:
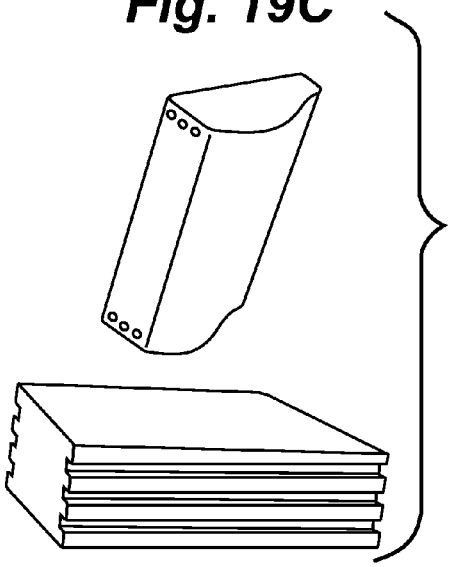
FIG. 19*c* is an exploded view of the seat and back portion showing structure on the seat and back that can facilitate adjusting the seat and back portion.
Figure 19D:
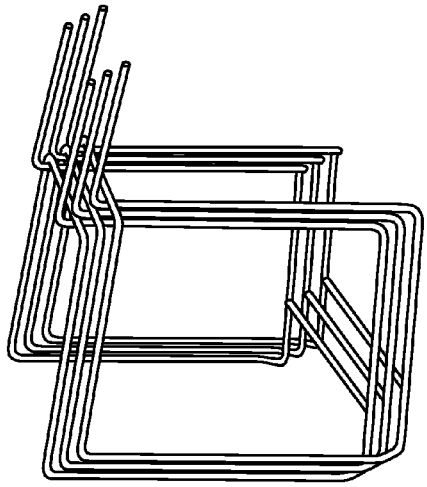
FIG. 19*d* shows a plurality of frames of the chairs of FIGS. 19*a* and 19*b* stacked together.
Figure 20C:
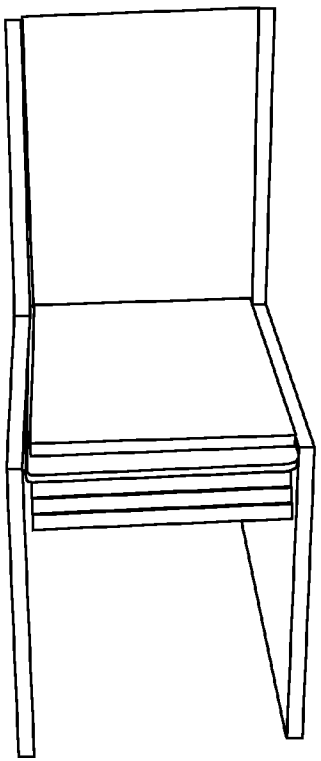
FIG. 20*c* is a front perspective view of the music posture chair of FIGS. 20*a* and 20*b*.
Figure 20A:
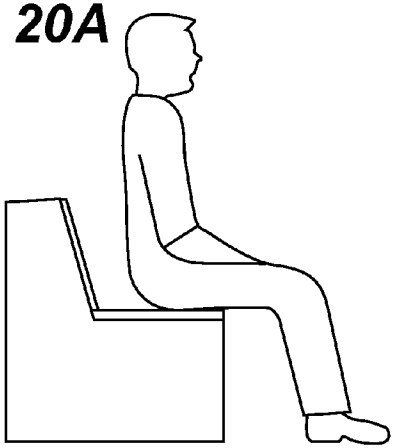
FIGS. 20*a* and 20*b* are side perspective views of a music posture chair having interchangeable cassettes or seat portions that can adjust the seat height and depth to accommodate a variety of users.
Figure 20B:
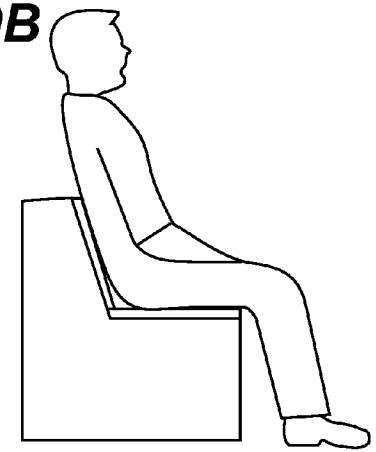
Figure 21A:
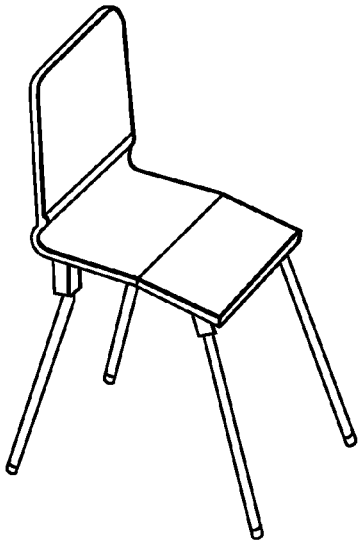
FIG. 21 shows an embodiment of a music posture chair having one-piece upper seat/back portion and removable legs that facilitate varying the height of the chair.
Figure 21B:
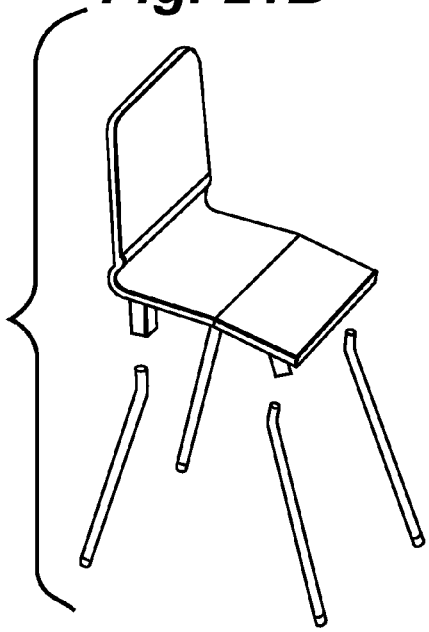
Figure 21C:
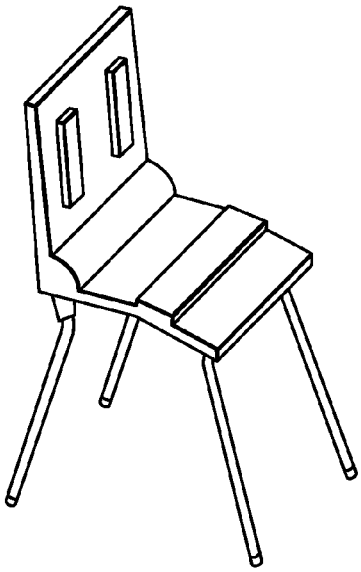
Figure 21D:
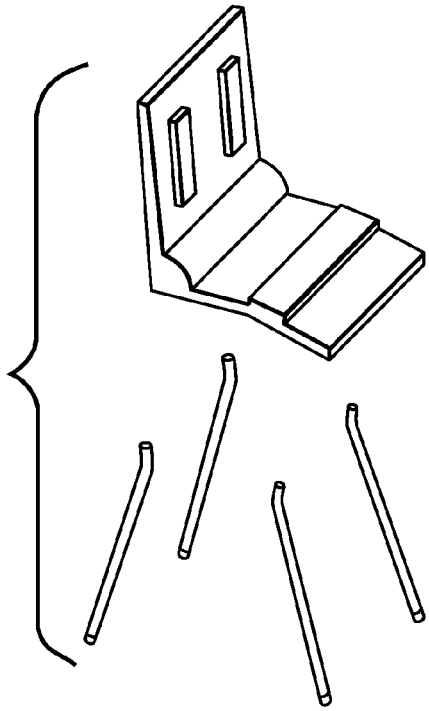
Figure 22C:
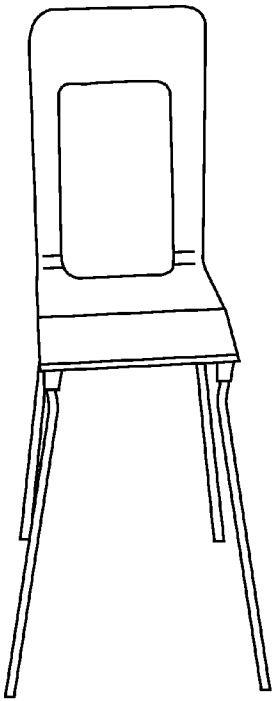
FIG. 22*c* is a front perspective view of the music posture chair of FIG. 21.
Figure 22A:
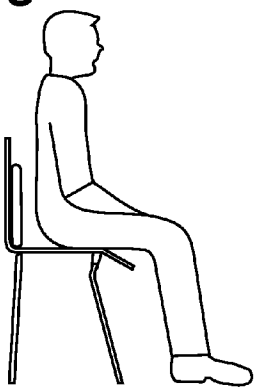
FIGS. 22*a* and 22*b* are side perspective views of the music posture chair of FIG. 21.
Figure 22B:
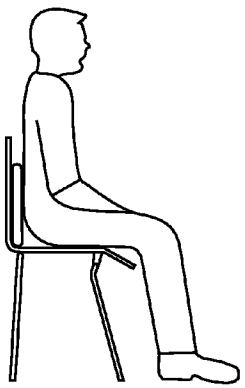
Figure 23A:
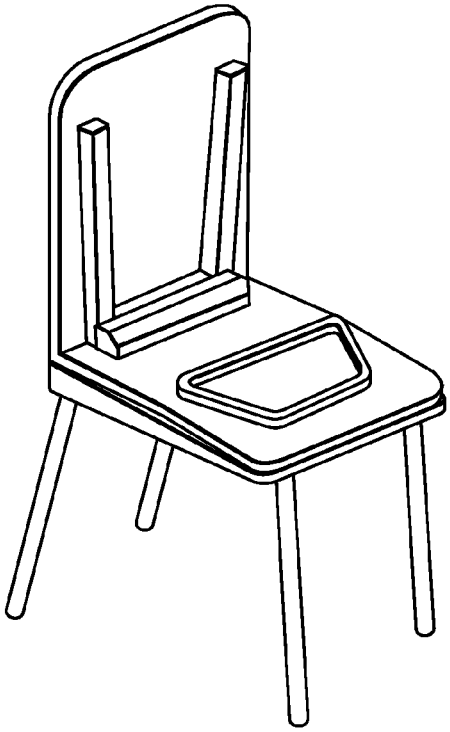
FIG. 23 shows a music posture chair having removable legs and interchangeable seat pads with posture elements.
Figure 23B:
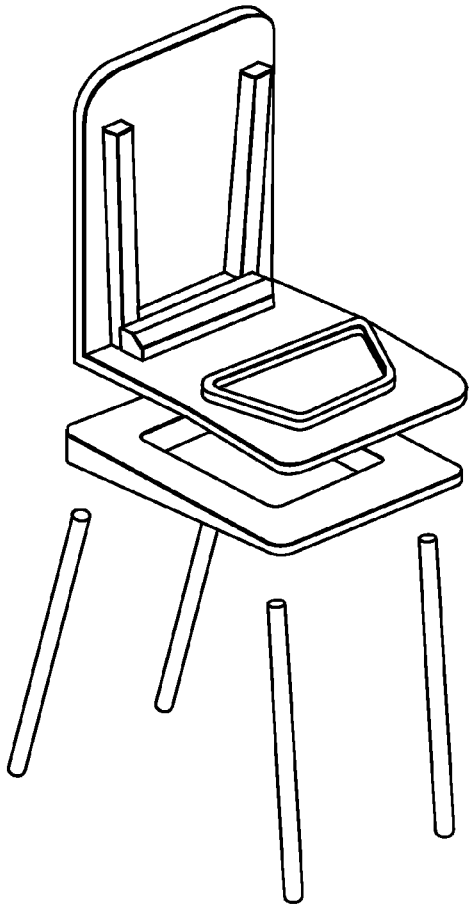
Figures 24A, 24B, 24C:
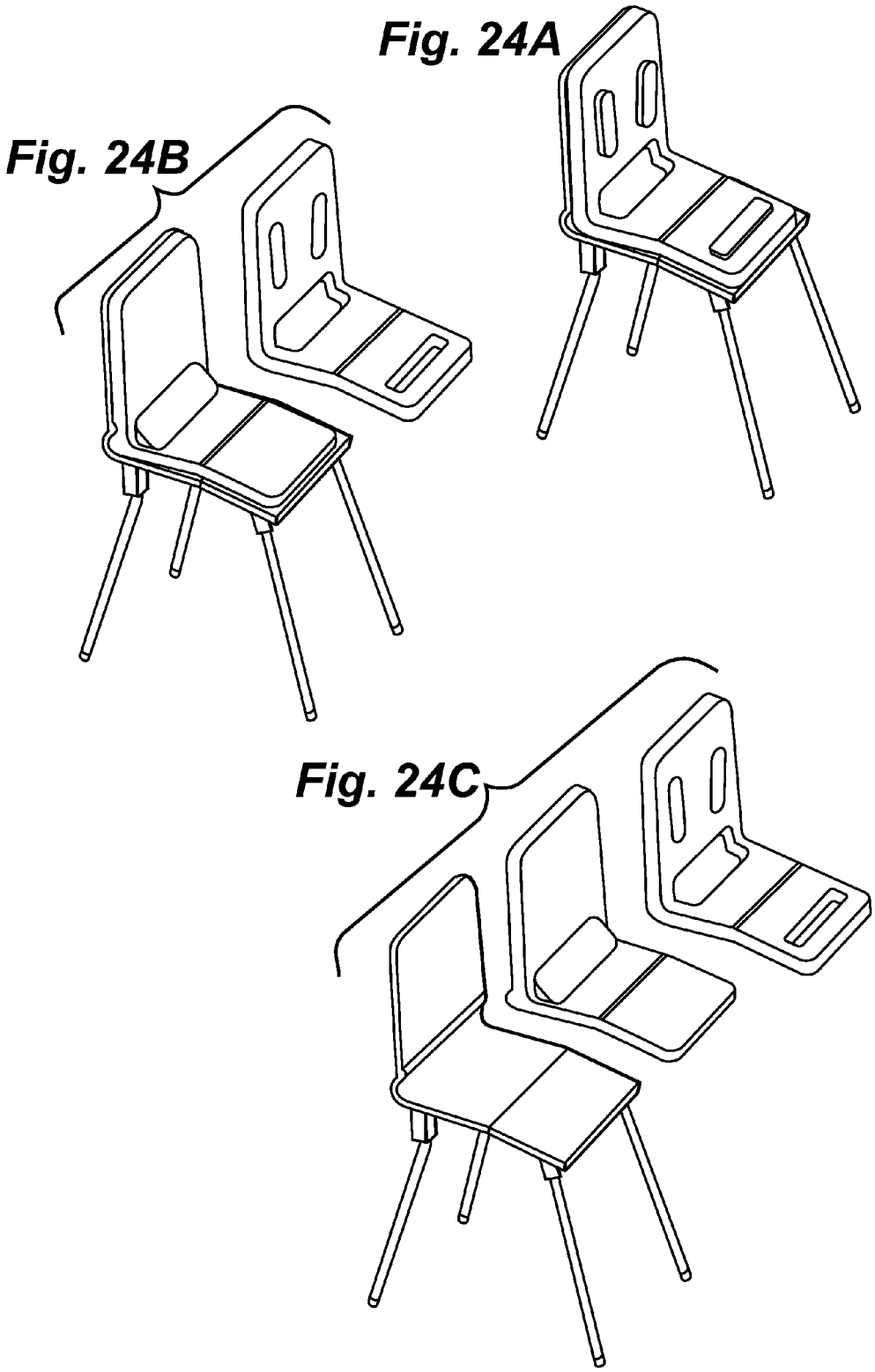
FIG. 24 shows a music posture chair a base/seat portion a middle layer and an outer base/sear shell, with posture elements formed by the middle layer being modified hen the base and shell portions are operably coupled.
Figure 25C:
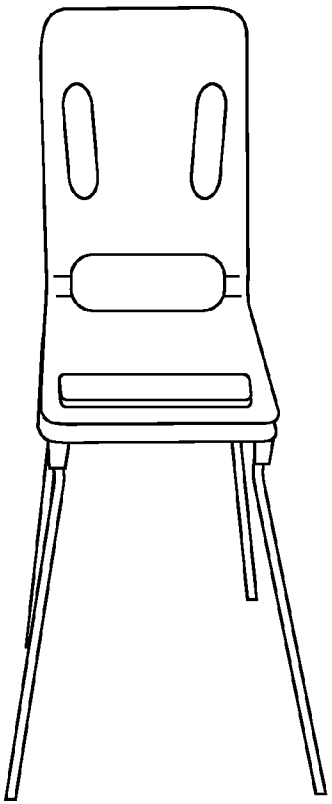
FIG. 25*c* is a front perspective view of the music posture chair of FIG. 24 showing the middle layer squeezed between outer layers to create posture elements.
Figure 25A:
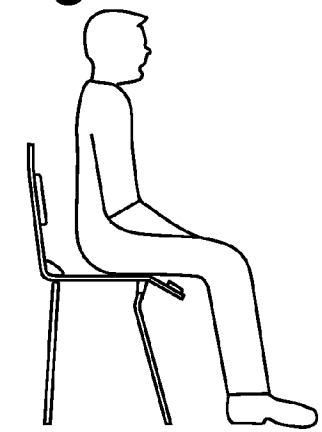
FIGS. 25*a* and 25*b* are side perspective views of the music posture chair of FIG. 24.
Figure 25B:
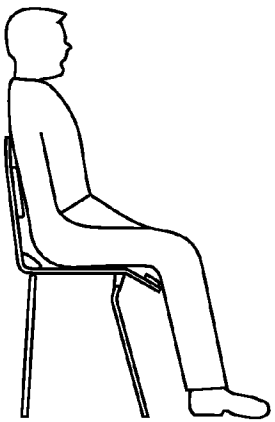
Figure 26A:
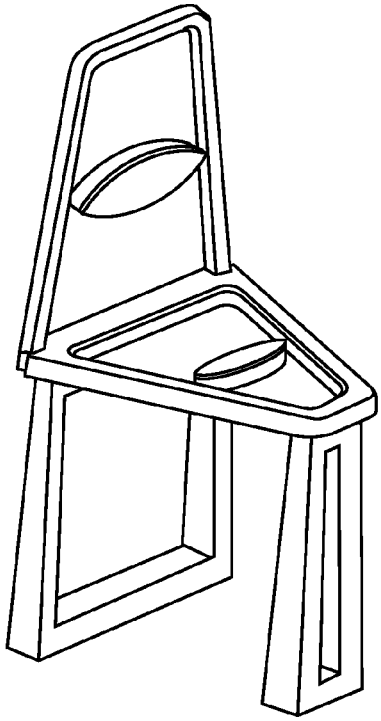
FIG. 26 shows a music posture chair having integral posture elements formed onto the base and seat portion.
Figure 26B:
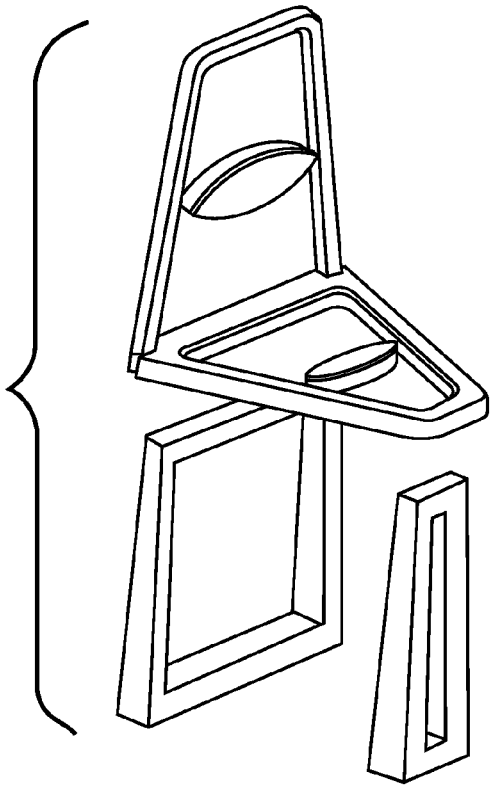
Figure 27C:
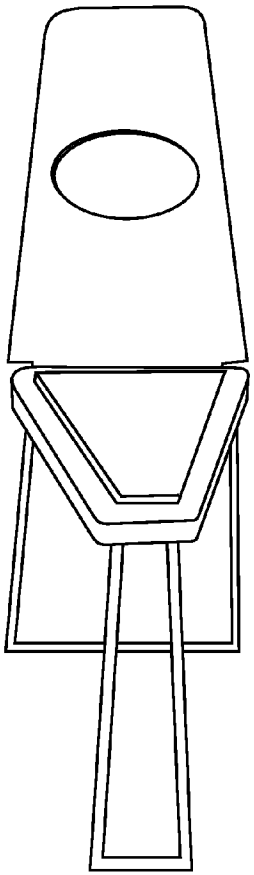
FIG. 27*c* is a front perspective view of the music posture chair of FIG. 26 showing the integral posture elements on the back portion and the seat portion.
Figure 27A:
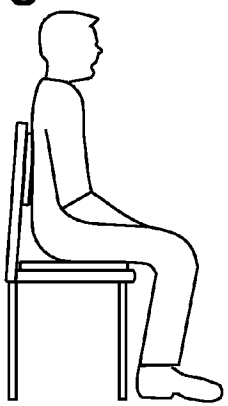
FIGS. 27*a* and 27*b* are side perspective views of the music posture chair of FIG. 26.
Figure 27B:
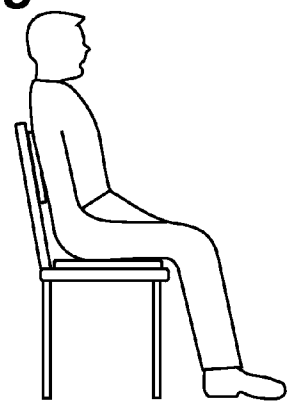
Figure 28A:
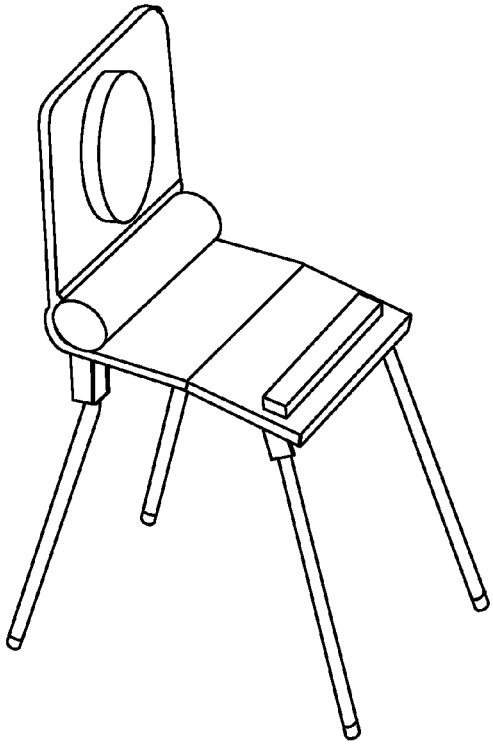
FIG. 28*a* shows an embodiment of a music posture chair having interchangeable posture elements connected to the chair.
Figure 28B:
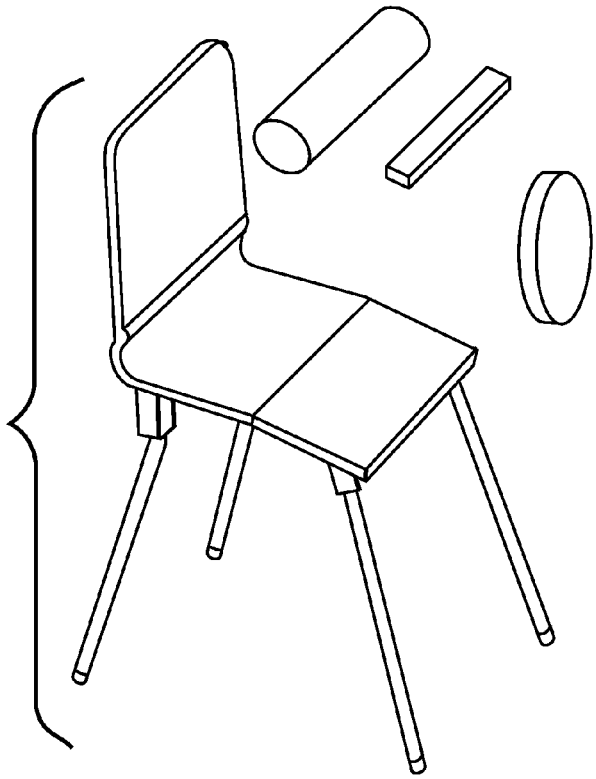
FIG. 28*b* is the music posture chair of FIG. 28*a* with the interchangeable posture elements shown exploded from the chair.

Referring to FIGS. 17*a* and 17*b*, a music posture chair 320 is shown comprising frame 322, seat portion 324 connected to frame 322 and back portion 326 connected to frame 322. As shown in FIGS. 17*a* and 17*b*, frame 322 can comprise and angled section 328 which permits chair 320 to rock from an engaged position shown in FIG. 17*b* to a perched position shown in FIG. 17*a*. FIG. 18*a* shows a user seated in music posture chair 320 in a perched position, while FIG. 18*b* shows a user seated in chair 320 in an engaged position.

Referring to FIGS. 19-28, embodiments of music posture chairs are shown comprising features that can be adjusted by the customer or user. In some embodiments, the adjustable feature can comprise the height of the back, the height of the seat, the height of the legs, adjustable seat pads, adjustable back pads, interchangeable posture elements and combinations thereof. In general, these embodiments provide the user with the ability to easily customize the music posture chair to provide desired support and comfort for a particular user.

Figure 29:
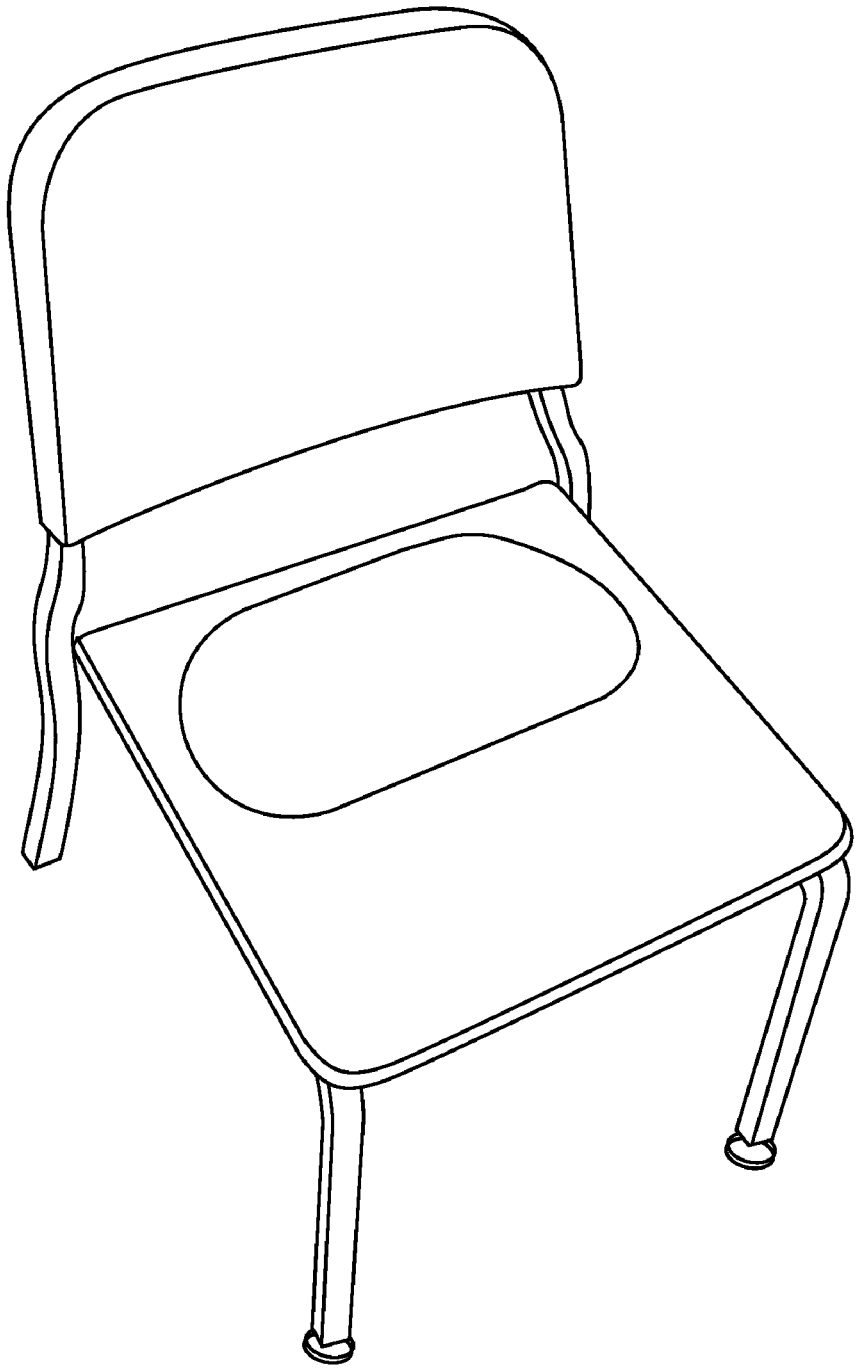
FIG. 29 shows an embodiment of a music posture chair having a seat cushion that encourages a user to sit in a desired location on the seat of the chair.
Figure 30C:
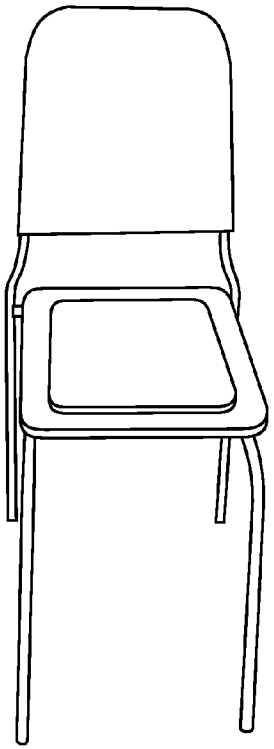
FIG. 30*c* is a front perspective view of the music posture chair of FIGS. 30*a* and 30*b* showing the mesh seat surface located on the seat portion of the chair.
Figure 30A:
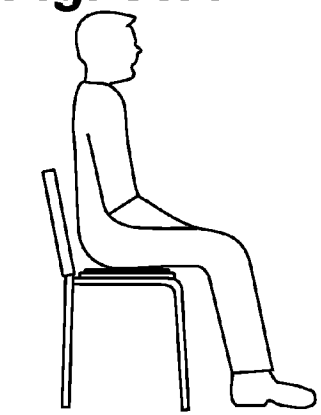
FIG. 30*a* and FIG. 30*b* are side perspective view of a music posture chair having a mesh seat surface on the seat portion of the chair.
Figure 30B:
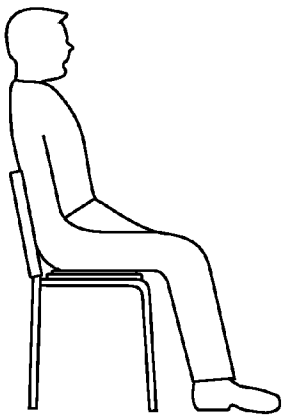
Figure 31:
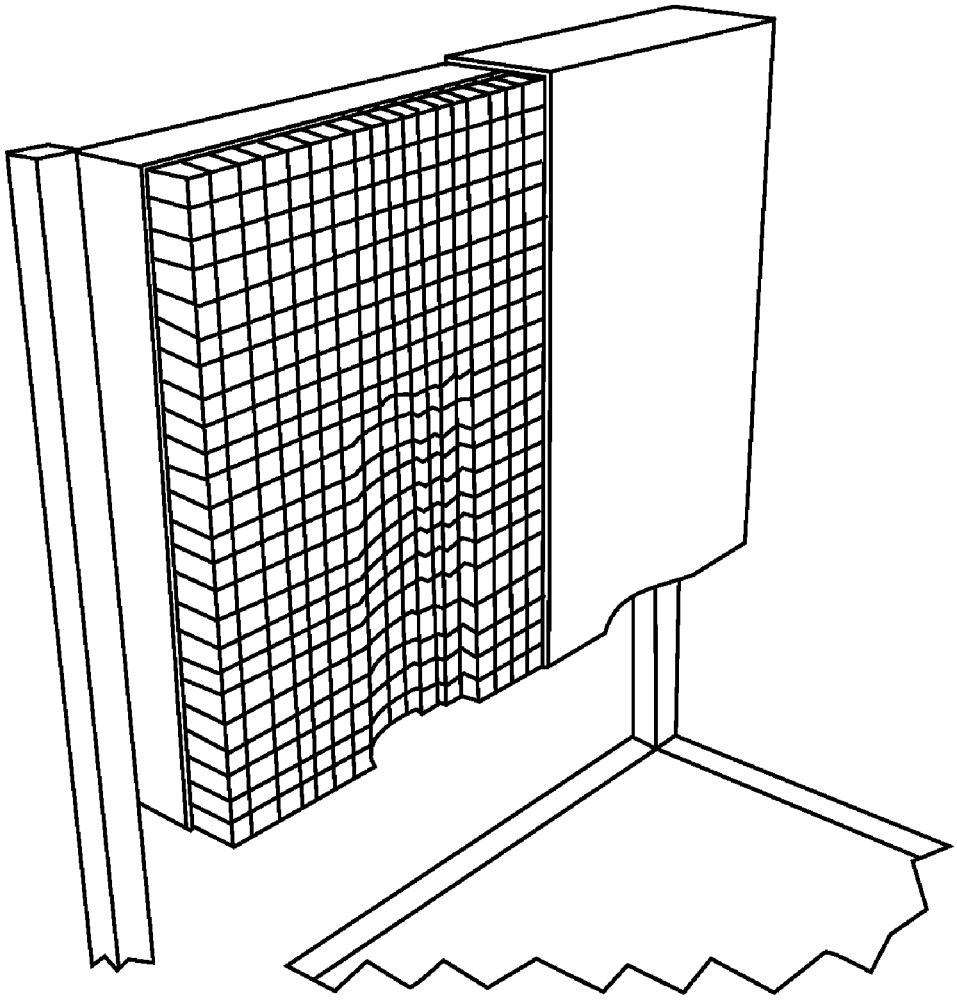
FIG. 31 is a partial perspective view of a music posture chair having a seat back comprising a plurality of axially adjustable element that can move to conform to the shape of a user's back.

Referring to FIGS. 29-31, in some embodiments, the music posture chairs of the present disclosure can comprise cushioning material such as, for example, a foam or mesh surface on the seat to encourage a user to sit in a desired location on the seat. Additionally, or alternatively, the back and/or seat portions of the music posture chairs of the present disclosure can comprise a plurality of axially adjustable elements as shown in FIG. 31, which can contour to the shape of a user's back and/or seat in order to provide desired levels of support and comfort for a particular user. The adjustable elements may be kept in place using various mechanical or electrical methods. In use, the performer would lean into the back and contact the adjustable elements, displacing them and conforming the elements in the back to the shape of the performer's back. The elements may then be locked into place. Spring cushioning may also be accomplished by making the elements out of an elastomeric or foamed material or making them as a spring.

Referring to FIGS. 32*a-c*, a music posture chair 400 is depicted including frame 402, seat portion 404 and back portion 406. Seat portion 404 and back portion 406 can be operably connected to frame 402. In these embodiments, seat portion 404 can have a topology that facilitates desired posture. As depicted in FIGS. 32*a-c*, seat portion 404 can have a front portion that is curved and/or slopes downward. Additionally, in these embodiments, the height of back portion 406 can be adjustable.

Figure 33:
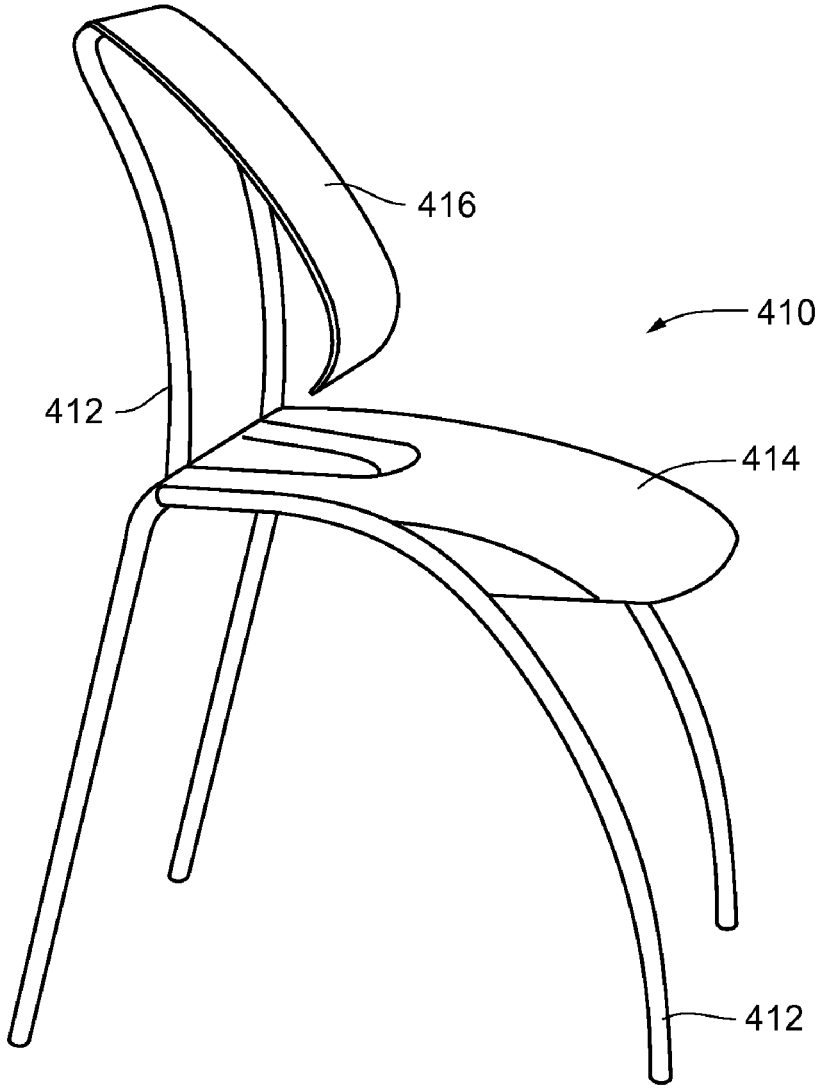
FIG. 33 is a side perspective view of a music posture chair having a back portion that can deflect or adjust to facilitate good posture.

Referring to FIG. 33, music posture chair 410 can comprise frame 412, seat portion 414 and back portion 416. Back portion 416 and seat portion 414 can be operably coupled to frame 412. In these embodiments, seat portion 414 can have a front portion that is curved and/or slopes downward. Additionally, back portion 416 can be coupled to frame 412 such that back portion 416 can deflect or adjust to facilitate good posture by the individual using the chair. In other words, the back portion 416 can "coach" the user into a desired posture.

Figure 34B:
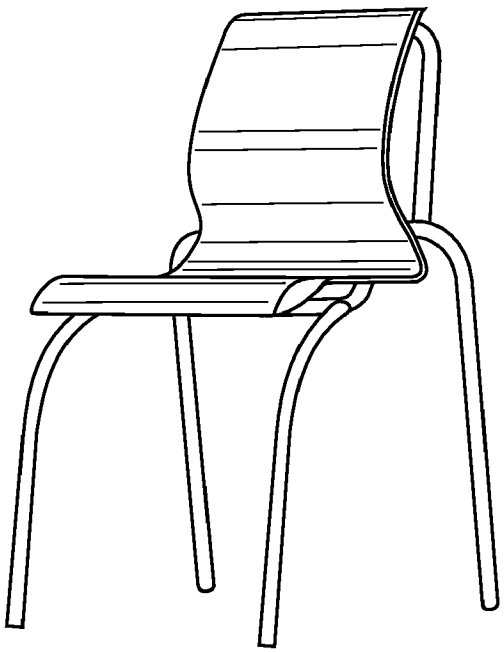
FIG. 34*b* is a front perspective view of the music posture chair of FIG. 34*a*.
Figure 34A:
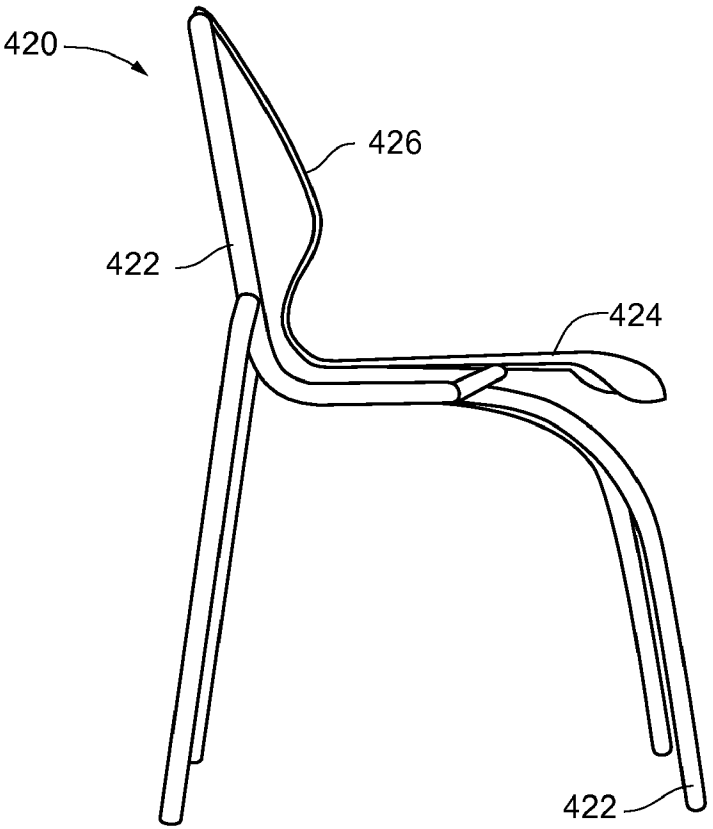
FIG. 34*a* is a side perspective view of a music posture chair having a curvature to the seat/back portion that supports a user's lower back.

Referring to FIGS. 34*a-b*, music posture chair 420 includes frame 422, seat portion 424 and back portion 426. In these embodiments, seat portion 424 can be integrally formed with back portion 426 to form a seat/back portion. Additionally, music posture chair 420 can include a curvature to the seat/back portion that supports a user's lower back. In these embodiments, the seat/back portion can bend or adjust in response to positioning of the user.

Figure 35B:
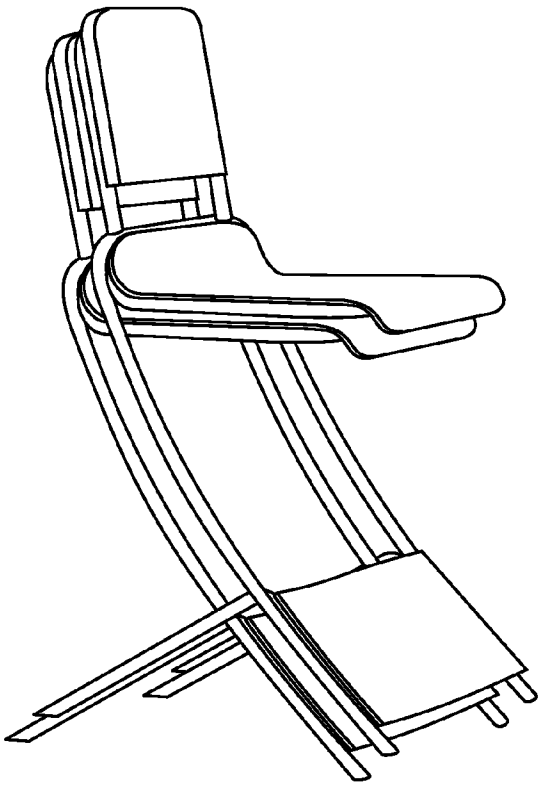
FIG. 35*b* is a side perspective view of the music posture chair of FIG. 35*a*, depicting the stackable feature of the chair.
Figure 35A:
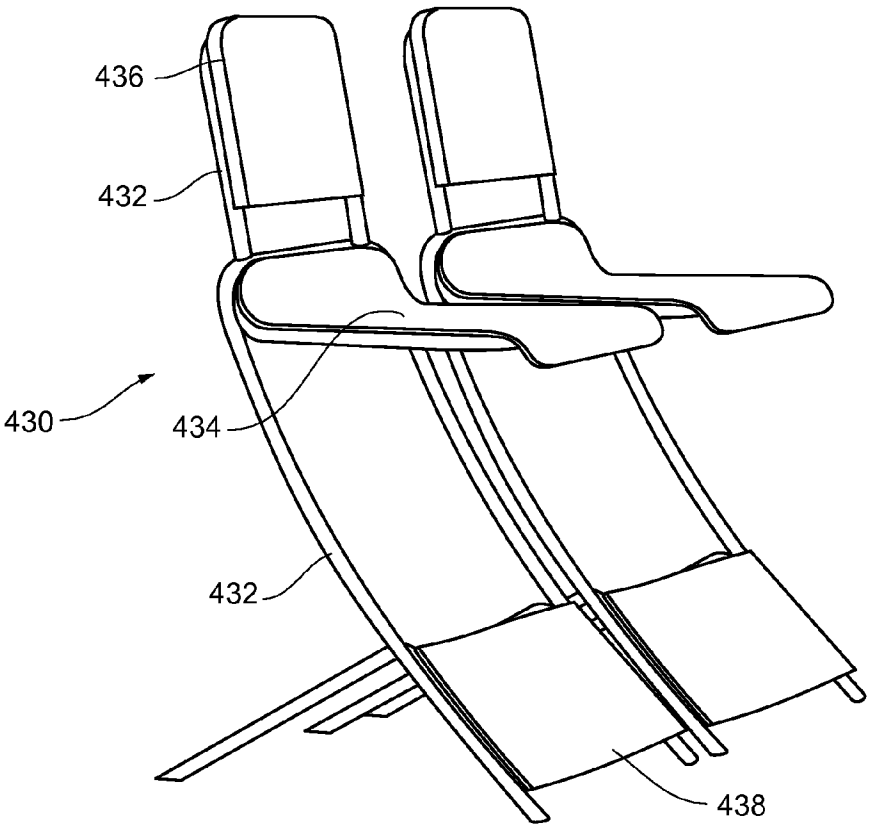
FIG. 35*a* is a side perspective view of a music posture chair including a foot ramp that aids in obtaining a desired spinal position when the user is seated on the chair.

Referring to FIGS. 35*a-b*, music posture chair 430 can include frame 432, seat portion 434 and back portion 436. Seat portion 434 and back portion 436 can be operably coupled to frame 432. In addition, chair 430 can also includes foot ramp 438 that aids in obtaining a desired spinal position when the user is seated on the chair. More specifically, foot ramp 438 can help facilitate a natural spinal curve by moving the user forward in the chair. Additionally, as depicted in FIG. 35*b*, chair 430 is stackable to facilitate easier storage of a plurality of chairs.

Figure 36:
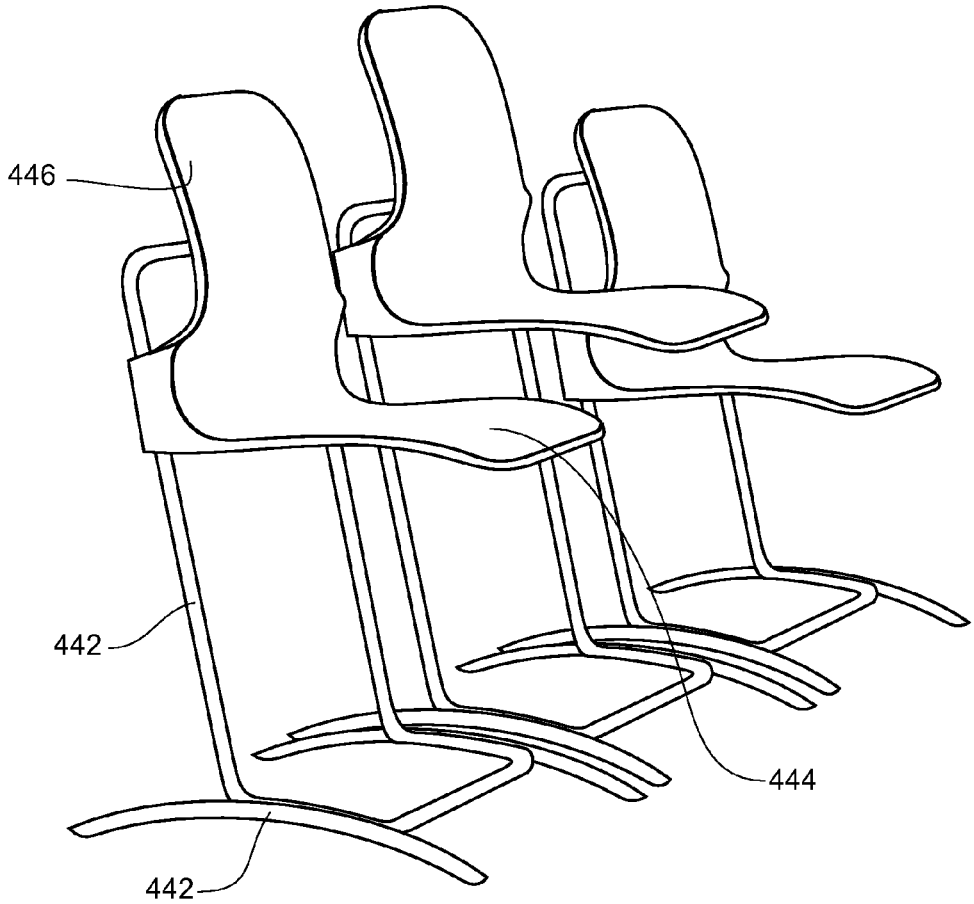
FIGS. 36*a-c* are side perspective views of a music posture chair having a cantilever design that facilitates height adjustment of the chair.

Referring to FIGS. 36*a-c*, music posture chair 440 can include frame 442, seat portion 444 and back portion 446. In some embodiments, seat portion 444 and back portion 446 can be integrally formed together. In these embodiments, a cantilever design can facilitate height adjustment of seat portion 444 and back portion 446.

Figure 37A:
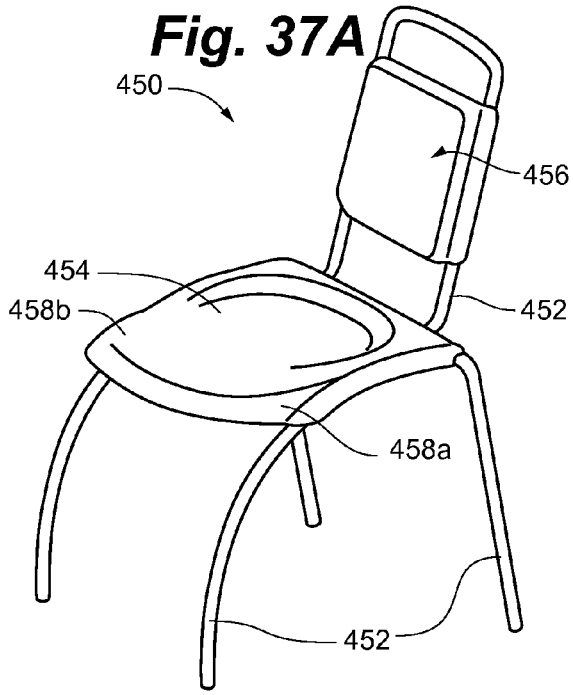
FIG. 37*a* is a side perspective view of a music posture chair.
Figure 37B:
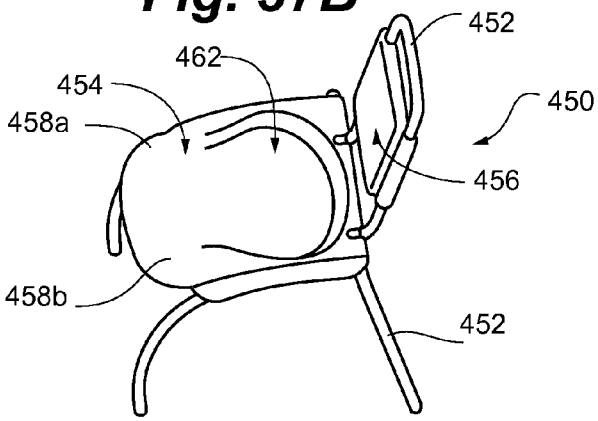
FIG. 37*b* is a top perspective view of a music posture chair.
Figure 37C:
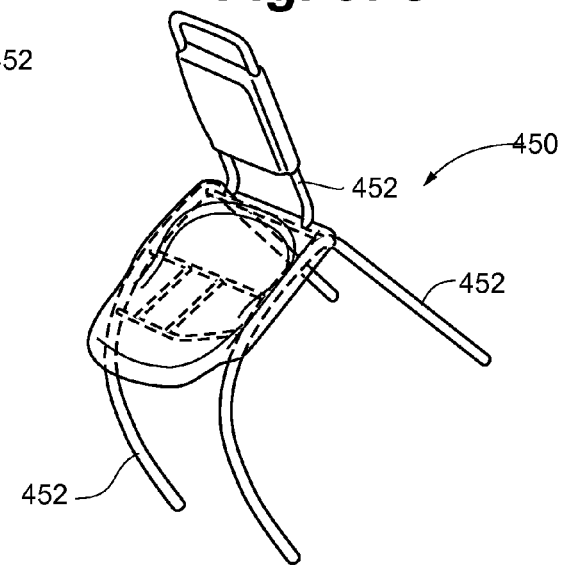
FIG. 37*c* is a bottom perspective view of a music posture chair.

Referring to FIGS. 37*a-c*, music posture chair 450 can include frame 452, seat portion 454 and back portion 456. Back portion 456 may be moveable in a vertical direction along the frame 452 of the chair allowing adjustment by the user. Seat portion 454 may define sculpted regions 458*a* and 458*b* over front legs of frame 452.

One embodiment of the invention is directed toward a chair having a static seat comprising two zones for placement of the performer's pelvis therein. The first zone is located closer to the rear edge of the seat (and therefore the back) and is also lower in height relative to the floor than the second zone. The first zone and the second zone may be connected by a relatively smooth transition zone. A smooth transition zone of a relatively shallow angle allows a user of the chair to change positions in the chair (e.g. from the pelvis in the first zone to the pelvis in the second zone) in a manner that is less obvious and therefore less distracting such as during a performance.

The first zone may be defined as a depression from a surface level of the seat and bounded along the rear and side edges of the seat. The transition zone may define the front boundary of the first zone. The boundaries of the first zone along the rear and sides will generally be more rounded and steeper in angle than the transition zone. The first zone may circular or oval in shape and positioned to receive the ischial tuberosities of the performer. Alternatively, the deepest portion of the first zone may be kidney bean shaped with the lobes of the bean shape located away from the seat back and positioned specifically to receive the ischial tuberosities of the performer. In some embodiments, the first zone may be configured to receive the ischial tuberosities of the performer as the performer is seated with legs (thighs) facing straight forward on the chair. However, the first zone is optimally configured to allow the user to move their legs toward one side or another with consequent relocation of the ischial tuberosities of the performer in the first zone in a way that minimizes or eliminates any discomfort to the performer in this region. The posterior region of the first zone may or may not be configured to engage the user. Where the posterior region is configured to engage the user, the point of contact may assist in urging the user to rotate their pelvis forward further ensuring proper lordotic curvature of the spine that will allow for greater freedom of movement of the diaphragm. The first zone may be textured as, for example by use of contrasting surfaces in an injection molded seat, to highlight the position of the first zone.

Figure 38:
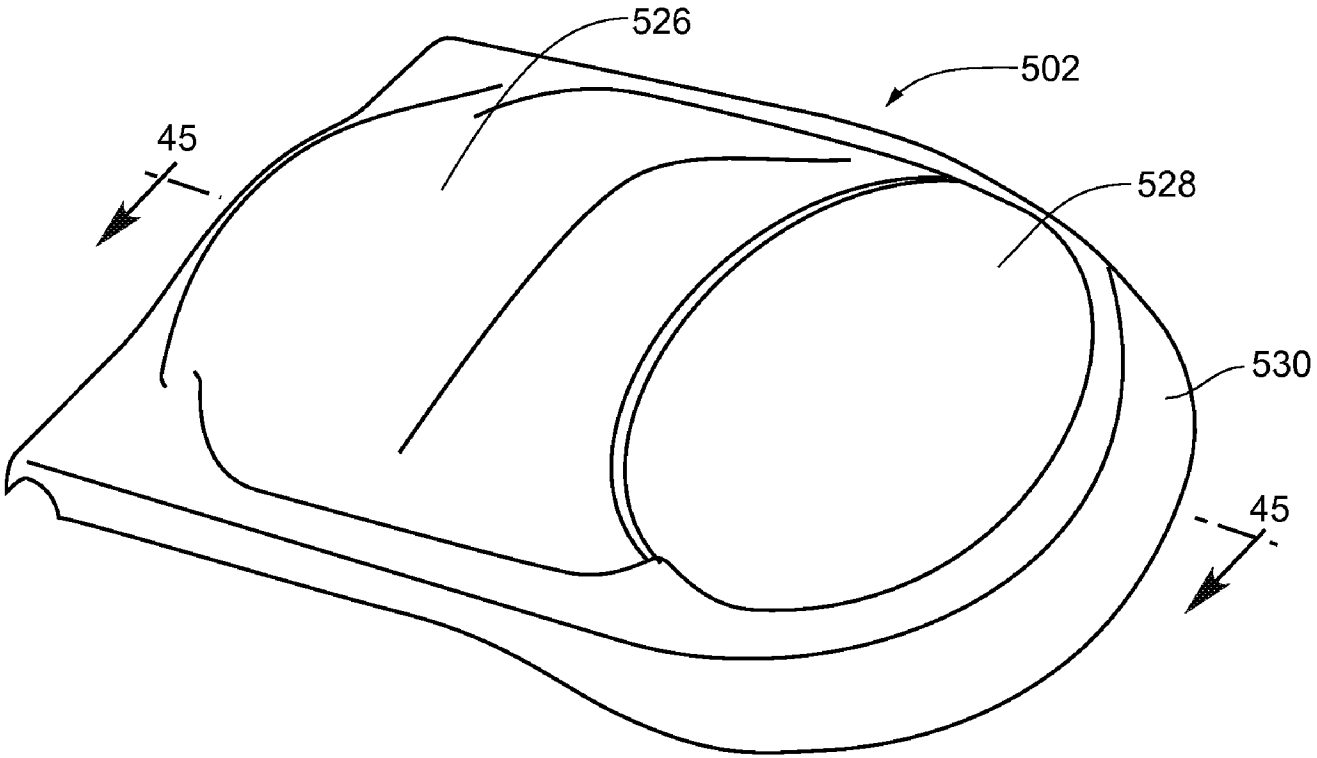
FIG. 38 is a side perspective view of a seat for a posture chair having two zones for seating that allow a user to perch forward comfortably and for the user to sit further back along the seat and at an elevation lower than in the perch position and further allowing the user to contact the back while maintaining a posture that allows for optimal performance.
Figure 39:
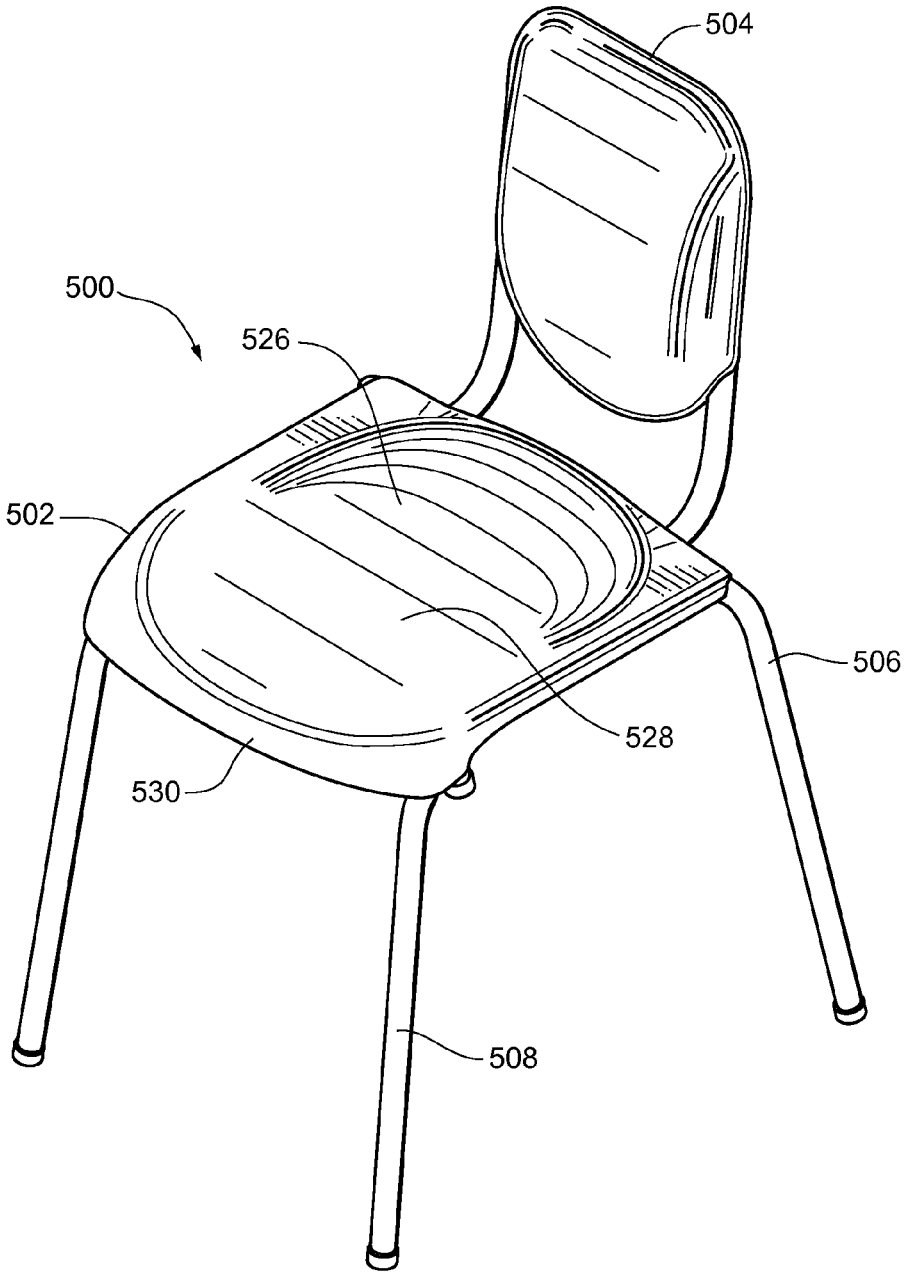
FIG. 39 is a side perspective view of the two zone chair.
Figure 40:
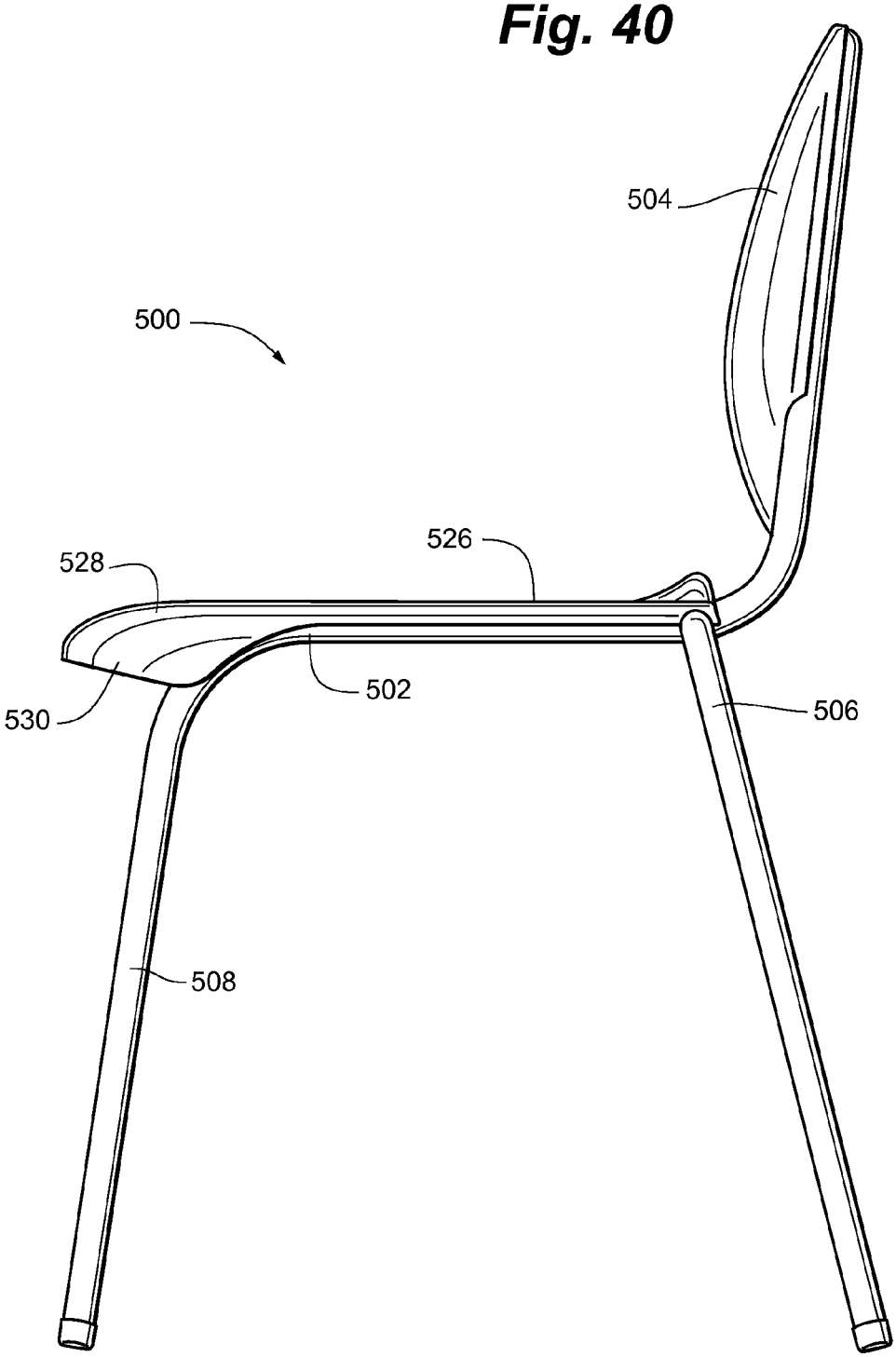
FIG. 40 is a side view of the two zone chair and showing seat extending over the front legs of the frame.
Figure 41:
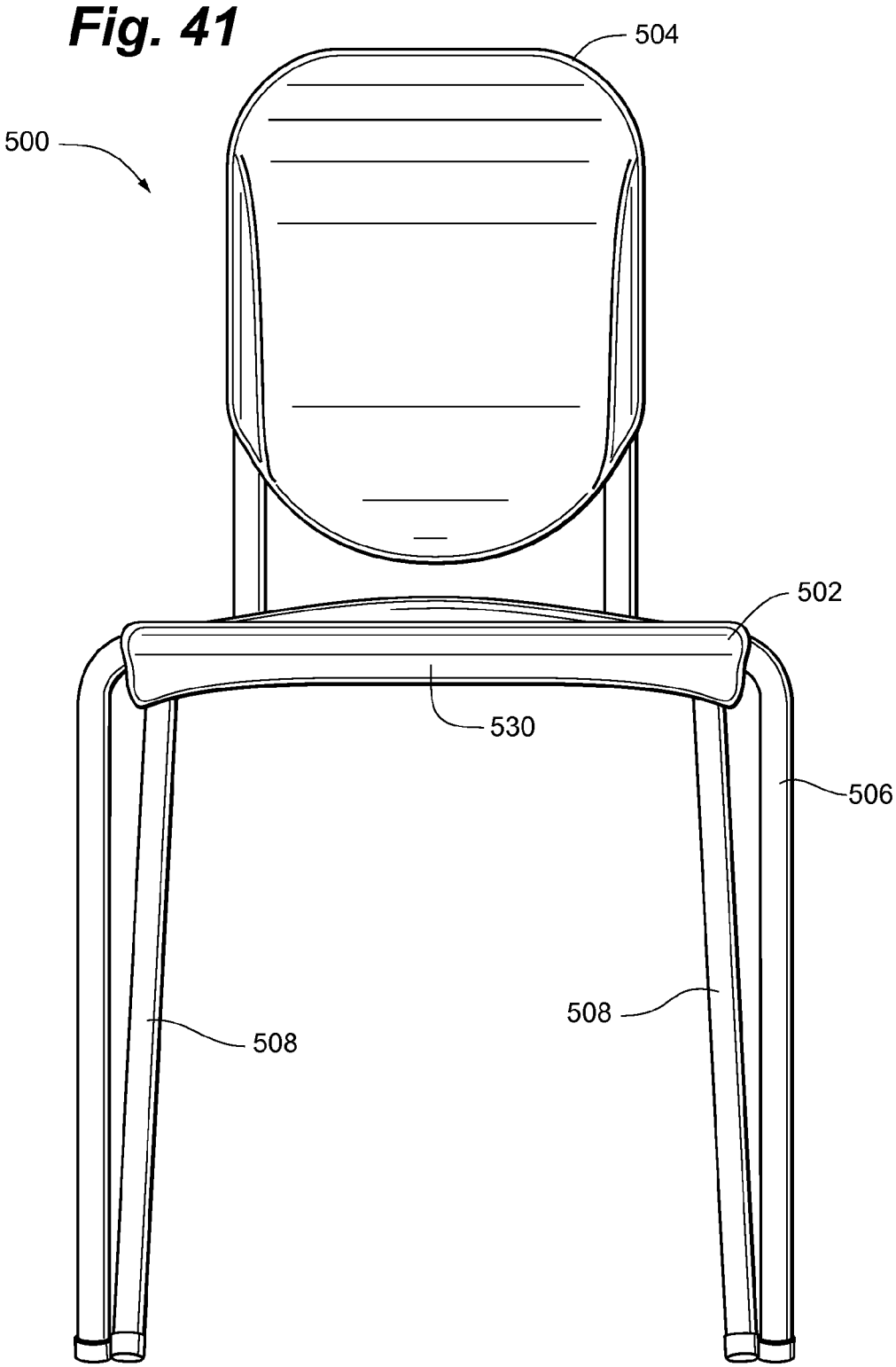
FIG. 41 is a front plan view of a two zone chair wherein the back is substantially narrower than the seat.
Figure 42:
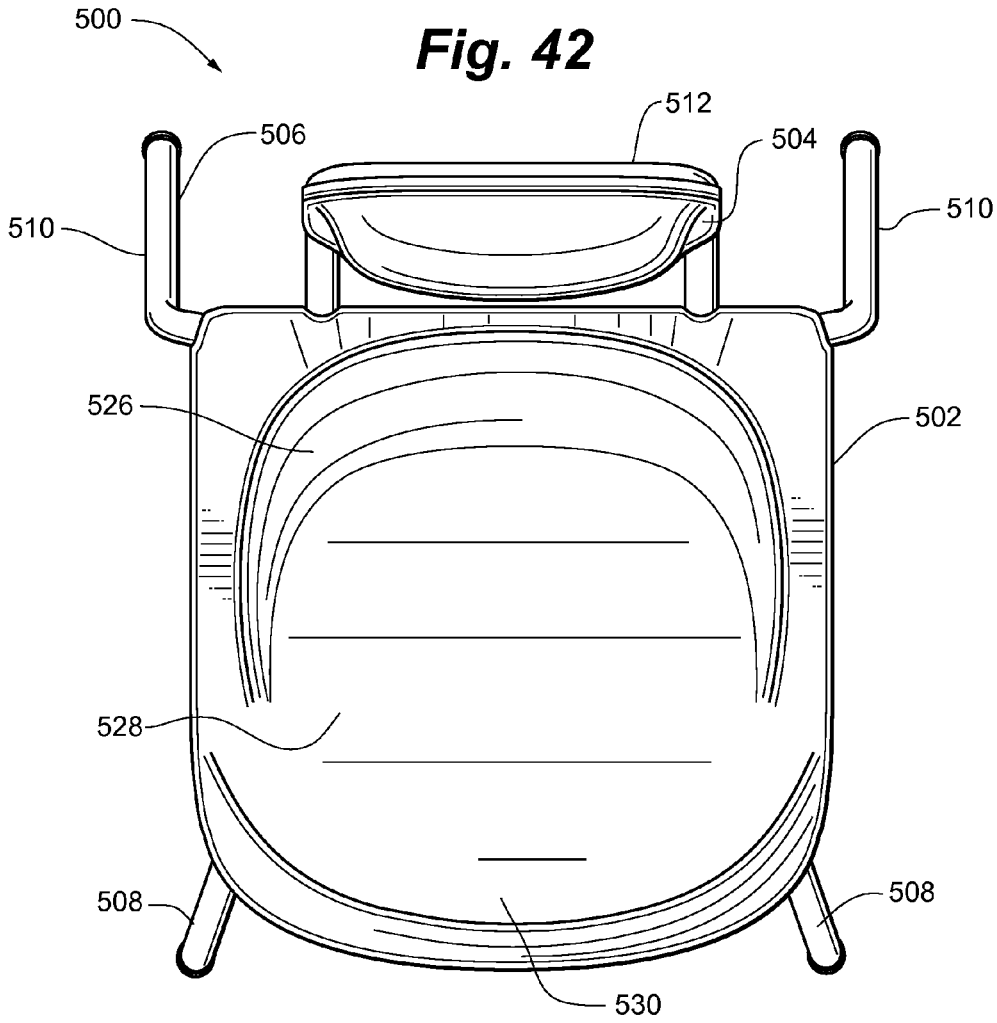
FIG. 42 is a top view of a two zone chair and shows the relation of the seat to the legs of the frame and the back.

The second zone is located anterior to the first zone and at a level elevated from the first zone. The second zone may be contiguous with the transition zone or the second zone may be defined as a flat circular or oval shaped region of the seat that is parallel or approximately parallel to the surface on which the chair is placed. In other embodiments, the second zone may be approximately circular or oval shaped and crowned or slightly elevated at the center of the second zone. The second zone may be textured as, for example by use of contrasting surfaces in an injection molded seat, to highlight the position of the second zone. An example of texturing of the second zone may be seen in FIG. 38. The transition zone and the second zone do not have any ridges located at or near the central plane of the seat, thus allowing the user to place their legs on the seat at angle that is not parallel to the central plane of the seat.

Anterior to the second zone, the seat drops off in a rounded or waterfall fashion allowing a user to sit in a perch position in the second zone on the chair, to drop their knees toward the floor and still maintain circulation to their legs. The waterfall geometry also allows the downward angle of the thighs, relative to the floor surface, to be maintained in the desirable range of six to sixteen degrees, whether the user is seated in the first zone or the second zone and whether the legs of the performer are oriented straight forward or are pointed to one side or the other. The waterfall region may also permit the use to maintain thigh contact with the seat allowing for more stability in the perch position and for better posture while still allowing circulation of blood to the legs. In one embodiment, the waterfall extends at least three inches from the second zone and falls off at least one inch between the second zone and the anterior edge of the seat. The waterfall may drop off from the second zone in a straight line thereby defining a mostly flat plane at the anterior edge of the seat. The waterfall may also drop off in a slight arc. In yet another embodiment, the waterfall may initially drop off at a shallow angle from the second zone and approximately half way between the second zone and the anterior edge of the seat begin to drop off at a slightly more acute angle. The waterfall portion of the seat may extend forward (anterior to the second zone) bounded on either side by a plane defined by the inside of the front legs. The waterfall portion of the seat may also extend over the front legs extending both forward and laterally around and over the front legs. This lateral extension of the waterfall over the front legs of the chair allows a user to perch in the second zone with legs turned to one side or another while still maintaining the advantages of the waterfall portion of the seat experienced when a user has their legs facing forward.

Figure 32:
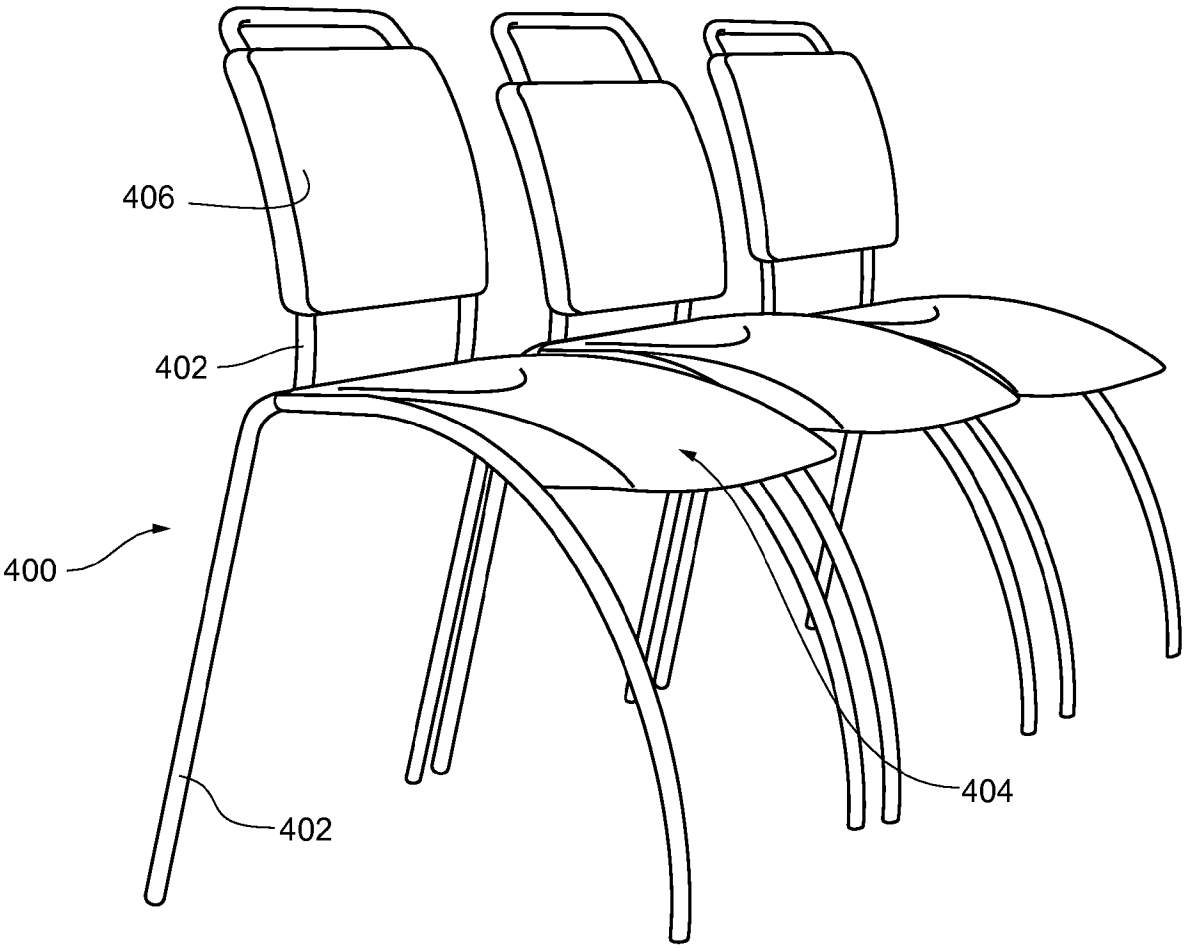
FIGS. 32*a-c* are side perspective views of a music posture chair having a seat topology that can promote desired posture.

A seat back that has a convex surface oriented toward the front of the chair and that is substantially narrower then the width of the seat may be used in conjunction with the two zone seat. The back may be convex in one dimension such as shown in FIG. 1*a* or in two dimensions such as shown in FIG. 37. In one embodiment, the convex seat back may be spherical or approximately spherical. In another embodiment, the convex seat back is shaped approximately as a rectangle and is mounted to a correspondingly shaped portion of the frame that is offset posterior from the seat. The convex seat back may be configured to provide support to the lumbar region of the spine as the user sits in the first zone or engaged position. The convex seat back would push on the lumbar region of the spine thereby inducing proper lordotic curvature in the lumbar region. In addition, the convex seat back may be configured to engage portions of the spine above and below the lumbar region providing, for example forward and upward pressure to the thoracic region of the spine of the user seated in the first zone of the seat. The convex seat back may be configured to provide forward and downward pressure to the sacral region of the spine of the user seated in the first zone of the seat. The convex seat back may work in conjunction with other elements of the chair to allow a user to contact the convex seat back while sitting in a position where the legs of the user are not parallel to a central plane of the chair running posterior to anterior. The convex seat back may be hollow to allow for closer nesting of the chair when stacked onto another similarly constructed chair having a convex back. The convex structure of the back obviates the need for cross bracing of the back below the top and between the two sides. The convex back as described herein may also be used in conjunction with other chairs as disclosed herein. To facilitate lifting of the chair, the convex back may define an opening along the top of the convex back allowing a person desiring to lift the chair access to a horizontal portion of the frame running behind the convex back. In other embodiments, the convex back may be adjustable relative to the height of the seat, allowing the user to adjust the area of interaction between the back of the user and the convex back. Various configurations of the convex back and mechanisms for adjustment (such as shown in FIG. 32) will be apparent to those skilled in the art.

The anterior portion of the seat including the transition zone, the second zone and the waterfall region may be further configured to allow the user seated in the first zone to move their legs from a straightforward position on the seat toward either side of the seat. When the seat is used with a convex back, the user is able to remain engaged with the back and still have the freedom of movement necessary to play instruments requiring arms to be held to one side (e.g. a flute or violin) or to hold a score or other printed material without interference from the seat back.

The seat and back may be made in a straightforward manner such as by plastic injection molding. Polypropylene or polyethylene may be used in construction of the seat, as may other plastics suitable for plastic injection molding.

Other materials may also be used

The frame may be made of steel and welded together. Other materials may also be used, including other metals, plastics, and wood either as components of the frame or in constructing the entire frame. In a two zone chair with a waterfall region extending over the front legs, the front legs of the frame may be positioned closer together than the back legs thereby staying out of contact with the user's feet and legs when the user is turned from a straightforward position on the seat.

A chair according to the invention may be constructed having a seat that is about 17 inches from the posterior edge of the seat to the most anterior portion and about 16.6 inches across from side to side at its widest. The first zone may be centered anterior to posterior on the seat at about 4.5 inches from the rear edge of the seat. The second zone may be centered anterior to posterior on the seat at about 13 inches from the rear edge of the seat. The highest portion of the second zone would be approximately 19 inches from the surface on which the chair is placed and approximately 0.63 inches higher than the lowest portion of the upper surface of the first zone. The angle of inclination between the first zone and the second zone would be about 9 degrees. In other embodiments, the angle of inclination for the transition zone may be between six and twelve degrees. The waterfall region may comprise the final three inches of the anterior portion of the seat and drop off posterior to anterior at a uniform rate to approximately one inch below the height of the second zone. The seat back may be about 10.9 inches across and about 2.2 inches from front to back. The portion of the seat back extending furthest in the anterior direction would be approximately 8.4 inches from the top of the back and be positioned to be about 25.25 inches from the surface on which the chair is placed. The portion of the frame on which the seat back is mounted may be approximately 97 degrees away from the plane of the surface on which the chair is placed resulting in the anterior-most portion of the back extending to a point just behind the rear of the seat. The two zone chair may be constructed in differing heights where, for example the highest portion of the second zone may be about 17 inches from the surface on which the chair is placed and the highest portion of the seat back would be about 23 inches from the surface on which the chair is placed. In a slightly taller version of the two zone chair the highest portion of the second zone may be about 21 inches from the surface on which the chair is placed and the highest portion of the seat back would be about 27 inches from the surface on which the chair is placed. It will be apparent that slight modifications of the angle of the transition zone, the shape and placement of the first and second zones, the thickness of the convex back and other measurements may be made to accommodate the slightly shorter or taller performers that would utilize these chairs.

While described herein as a static two zone chair, it will be apparent that various mechanisms may be added and various techniques used to create a dynamic version of the chair that would allow a performer, for example, to change the configuration of the chair to their preference. Such mechanisms and techniques are set forth in the present disclosure and may also include variously the use of hydraulics, air pressure, gels, additional cushioning to be placed on or over portions of the chair, use of bladders under upholstered surfaces on the seat or convex back (e.g. containing air, liquid or gel), straps or wires that could be tightened or loosened to reform portions of the seat or back.

The seat and convex back contemplated for use in the two zone chair would be polypropylene injection molded components. As mentioned, portions of the surfaces of each may be textured, various portions of the surface may be perforated either during molding or by drilling thereafter. In addition, the seat and convex back may be upholstered and various portions seat may also be cushioned, such as with foam padding or gel padding. Also, the seat and convex back may be produced using dual injection molding to give different levels of firmness to selected areas in order to increase comfort of the performer. Portions of the seat may incorporate a mesh fabric on which the performer would sit, thereby allowing for better heat transfer from the performer away from the chair.

The chairs of the invention may be moved from place to place by lifting the chair with one hand on the front of the seat, usually near the center, and one hand at the top of the back, under the back or under the rear of the seat. In the case of a plastic injection molded seat, however, the front edge of the seat may not be very thick and may even be rounded during finishing of the seat. As a result, that portion of the weight of the chair that is born by the hand in contact with the front of the seat will produce a concentrated force upon the hand potentially resulting in some discomfort. To facilitate lifting of the chair and reduce the forces on the hand in contact with the front of the seat, an area along the front rim of the seat, particularly in the center of the front rim, may be adapted to present a more ergonomic fit for a hand in contact with the seat. Such adaptations will generally allow the hand in contact with the front of the seat a greater area of surface contact thereby reducing the pressure on the hand or fingers at any one point of contact.

Figure 44:
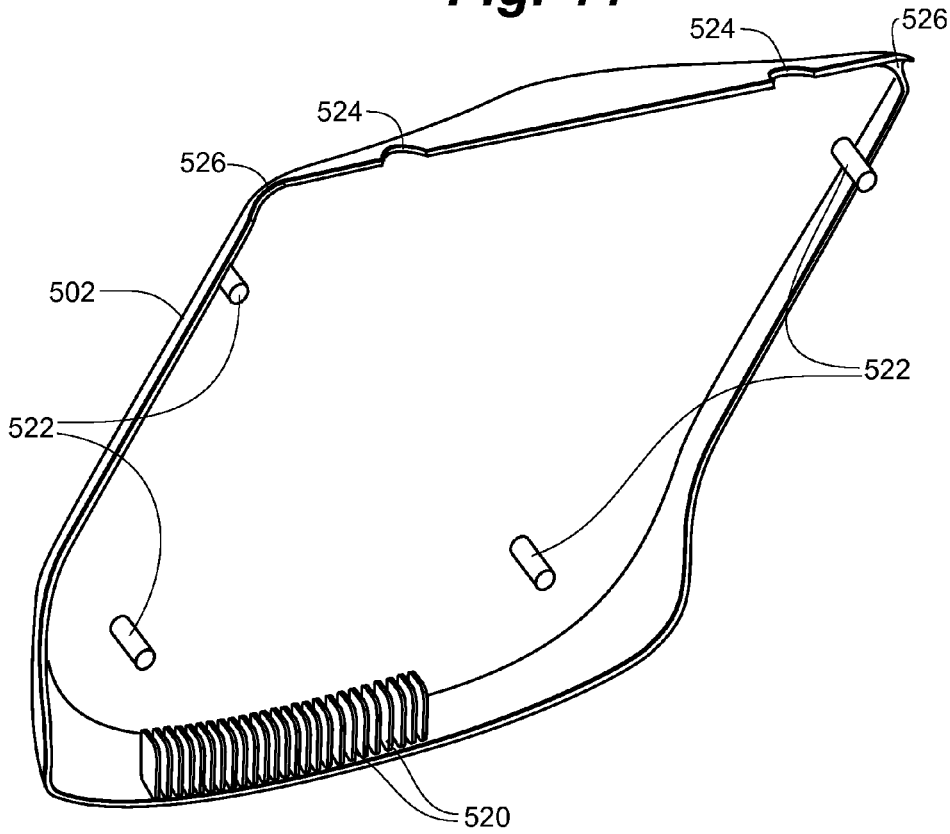
FIG. 44 is a bottom perspective view of a seat that may be utilized in construction of a two zone chair and shows multiple ribs located at the front of the seat that allow for better distribution of weight among fingers reaching under the seat as the chair is lifted.

In one embodiment, the underside of the seat may be molded with a set of parallel ridges running perpendicular or substantially perpendicular to the front edge of the seat as shown in FIG. 44. The ridges (520) may be placed at the center portion of the front of the seat and may be spaced closely enough to present a substantially more comfortable grip, yet far enough apart to allow for production of a durable mold and for reliable release of the seat from the mold during production. These ridges may also confer additional strength to the front rim of the seat allowing the waterfall portion to retain its shape.

Referring to FIGS. 38-42, chair 500 is shown having seat 502, back 504 and frame 506. A first zone 526 for placement of the pelvis on seat 502 is shown toward the rear of the seat. When the performer has their pelvis placed in the first zone, back 504 is positioned to engage the lumber (and optionally the sacral and the thoracic) spinal region of the performer encouraging correct posture for performance. A performer seated in the first zone is understood to be in an engaged position. A second zone 528 for placement of the pelvis on seat 502 in a perch position is shown at a location closer to the front of seat 502. When the chair is in use, second zone 528 is higher than first zone 526. Front portion 530 of seat 502 extends downward from second zone 528 toward the front of the chair and also toward the sides of the chair in a curved or "waterfall" portion and extends over the front legs 508 of frame 506.

Figure 43:
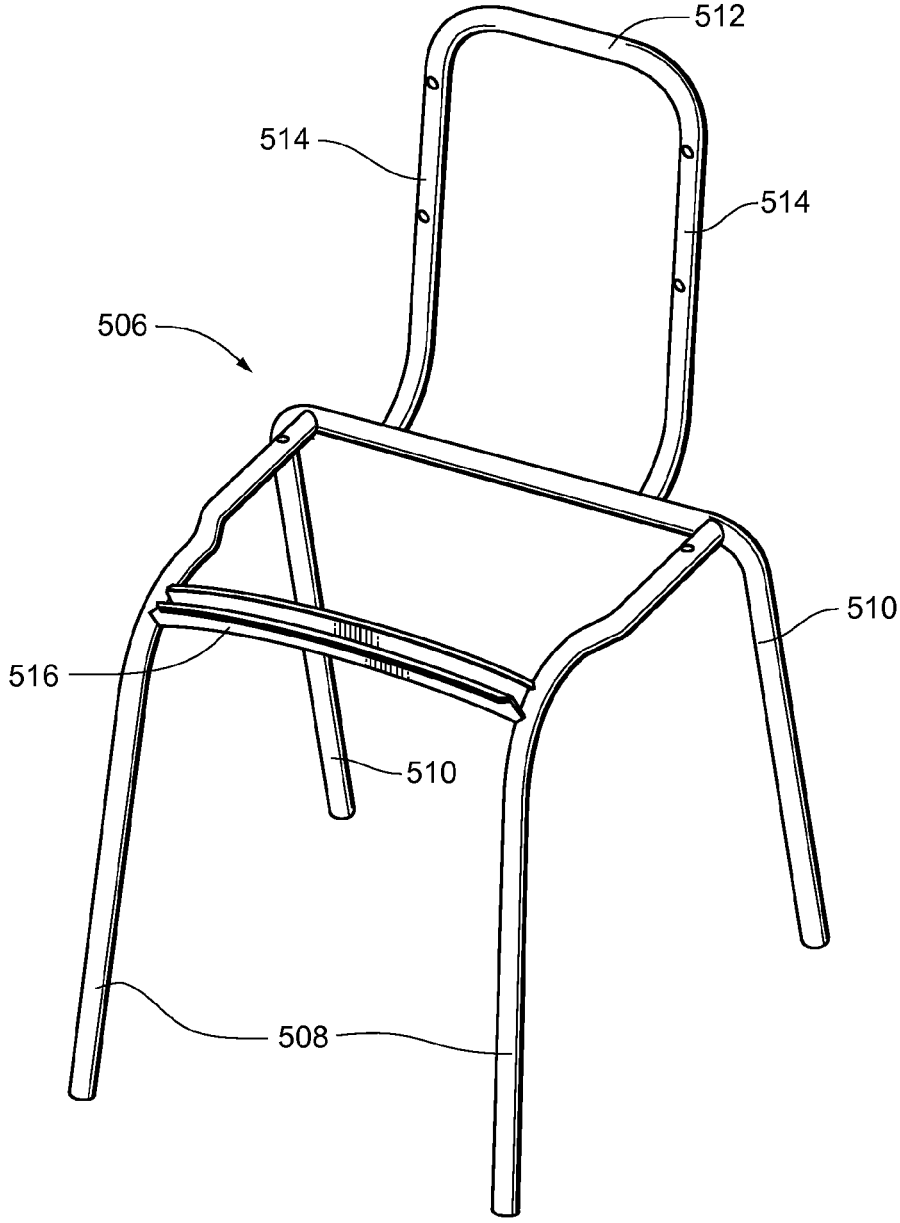
FIG. 43 is a side perspective view of a chair frame that may be utilized in construction of a two zone chair.

Referring to FIG. 43, a frame 506 for use in constructing a chair according to the present invention is shown. Cross bar 516 is located just above legs 508 providing a point of connection for seat 502 to frame 506. Upright bars 514 provide a connection for securing back 504 to frame 506. Seat back cross bar 512 provides a further point of connection for securing back 504 to frame 506 and preventing or further securing back 504 against vertical movement.

Referring to FIG. 44, the underside of seat 502 is shown prior to assembly onto frame 506. Posts 522 are provided for attaching seat 502 onto frame 506. Seat 502 further defines notches 524 and 526 that receive and partially surround portions of frame 506.

Figure 45:
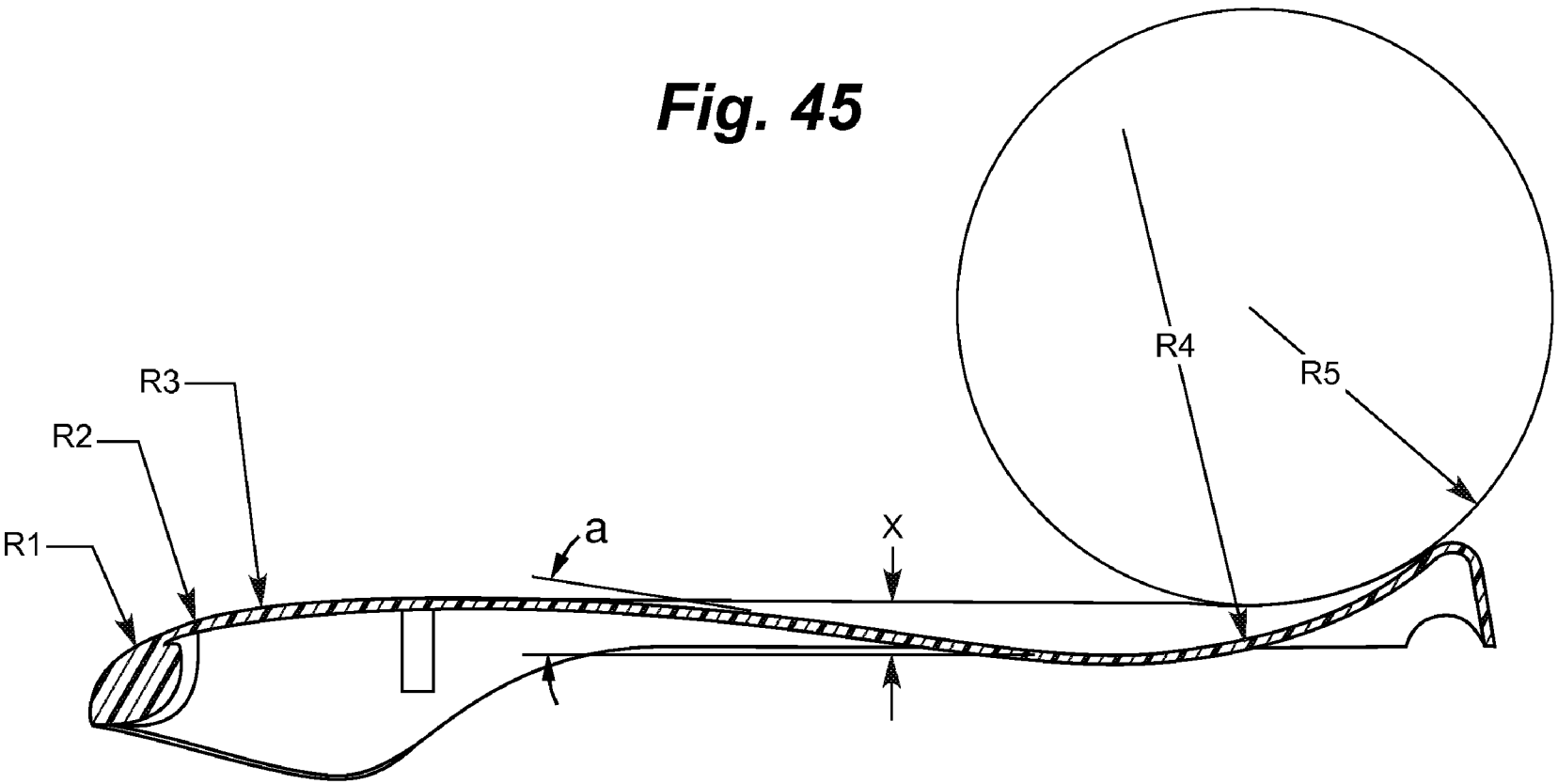
FIG. 45 is a sectional view of a seat for a two zone chair taken along line 45-45 of 38.

Referring to FIG. 45, a sectional view down the center of the seat is shown from a side view. The angle of inclination of the transition zone is shown as angle $\alpha$ which may be six to twelve degrees, or may be between eight and ten degrees and may be nine degrees. The waterfall region of the seat slopes according to three radii denoted R1, which may be about 0.9 inches, R2 which may be about 3.3 inches and R3 which may be about 14 inches. The difference in elevation between the seating surface of the first zone and the highest portion of the second zone is shown as variable X which may be about 0.55 to 1 inches, or may be about 0.6 to 0.9 inches or may be about 0.7 to 0.75 inches. Rear portion of first zone may slope upward according to two radii as shown in FIG. 45, R4 which may be about 6.5 inches and R5 which may be about 3.7 inches.

The embodiments above are intended to be illustrative and not limiting. Additional embodiments are within the claims. Although the present invention has been described with reference to particular embodiments, workers skilled in the art will recognize that changes may be made in form and detail without departing from the spirit and scope of the invention.

The invention claimed is:

1. A chair capable of enhancing the posture of a user, the chair comprising:

a frame having a pair of front legs, a rear leg assembly, a seat cross bar connecting the front legs, a pair of upright bars attached to the rear leg assembly and a seat back cross bar connecting the upright bars;

a seat pan connected to the frame through operable attachment to at least one of the rear leg assembly and the seat cross bar, the seat pan having a first placement zone defined at a rear portion of the seat, a second placement zone defined anterior and above the first placement zone and a front portion extending anterior and downward from the second placement zone; and an anterior-facing convex seat back connected to the frame through operable attachment to at least one of the upright bars and the seat back cross bar, the anterior-facing convex seat back positioned at least partially above the seat pan; and wherein the first placement zone is adapted to support a user's pelvis such that the anterior-facing convex seat back simultaneously engages the user to define a posture supporting engaged position, wherein the second placement zone and front zone are adapted to support the user's pelvis in a perch position, and wherein a highest point on the second placement zone is at least about 0.55 inches above a seating surface of the first placement zone.

2. The chair of claim 1, wherein the highest point on the second placement zone is about 0.55 inches to about 1.0 inches higher than the seating surface of the first placement zone.

3. The chair of claim 2, wherein the highest point on the second placement zone is about 0.6 inches to about 0.9 inches higher than the seating surface of the first placement zone.

4. The chair of claim 3, wherein the highest point on the second placement zone is about 0.7 inches higher than the seating surface of the first placement zone.

5. The chair of claim 1, wherein the first placement zone and the second placement zone are interconnected with a transition zone having an angle of elevation from about six degrees to about twelve degrees.

6. The chair of claim 5, wherein the angle of elevation is about nine degrees.

7. The chair of claim 1, wherein the front portion curls over at least a portion of the front legs.

8. The chair of claim 1, wherein the front portion defines a waterfall region having a first front slope, a second front slope posterior to the first front slope and a third front slope posterior to the second front slope, wherein the first front slope has a first curvature equivalent to a first radius, the second front slope has a second curvature equivalent to a second radius and the third front slope has a third curvature equivalent to a third radius, wherein the first radius is smaller than the second radius and the second radius is smaller than the third radius.

9. The chair of claim 8, wherein the first front slope has a first curvature equivalent to a first radius of about 0.9 inches, the second front slope has a second curvature equivalent to a second radius of about 3.3 inches and the third front slope has a third curvature equivalent to a third radius of about 14 inches.

10. The chair of claim 1, wherein the front portion includes a plurality of molded ridges on an underside of the seat pan, the plurality of molded ridges being arranged substantially at or near and perpendicular to a front edge of the front portion.

11. The chair of claim 1, wherein the first placement zone defines an upward sloping rear portion having a first rear slope and a second rear slope, wherein the first rear slope has a curvature equivalent to a first radius and the second rear slope has a curvature equivalent to a second radius, wherein the second radius is larger than the first radius.

12. The chair of claim 11, wherein the first rear slope has a curvature equivalent to a first radius of about 6.5 inches and the second rear slope has a curvature equivalent to a second radius of about 3.7 inches.

13. A chair comprising:

a frame having a pair of front legs, a rear leg assembly, a pair of upright bars attached to the rear leg assembly and a seat back cross bar connecting the upright bars;

a seat back attached to at least one of upright bar and the seat cross back bar, the seat back having an anterior facing convex surface; and a seat attached to the frame above the pair of front legs, the seat defining a first placement zone, a second placement zone, a transition zone and a front portion;

wherein the first placement zone defines an upward sloping rear portion having a first rear slope and a second rear slope posterior to the first rear slope, wherein the first rear slope has a curvature equivalent to a first radius of about 6.5 inches and the second rear slope has a curvature equivalent to a second radius of about 3.7 inches, wherein the transition zone interconnects the first placement zone and the second placement zone, the transition zone having an angle of elevation from about six degrees to about twelve degrees, wherein the second placement zone is located anterior to and above the first placement zone, and wherein the front portion defines a waterfall region extending anterior to and descending downward from the anterior of the second placement zone, the waterfall region having a first front slope, a second front slope posterior to the first front slope and a third front slope posterior to the second front slope, wherein the first front slope has a first curvature equivalent to a first radius of about 0.9 inches, the second front slope has a second curvature equivalent to a second radius of about 3.3 inches and the third front slope has a third curvature equivalent to a third radius of about 14 inches.

14. The chair of claim 13, wherein a highest point on the second placement zone is at least about 0.55 inches above a seating surface of the first placement zone.

15. The chair of claim 13, wherein the front portion includes a plurality of parallel ridges on an underside of the front portion, the plurality of parallel ridges being arranged substantially perpendicular to a front edge of the front portion so as to reinforce the waterfall region.

16. The chair of claim 13, wherein the frame comprises a pair of front legs and wherein the front portion of the seat at least partially curls over the frame so as to at least partially cover a pair of front legs and a seat cross bar on the frame.

17. The chair of claim 13, wherein an engaged position is defined by a user simultaneously engaging the first placement zone and the anterior facing convex surface on the seat back.

18. The chair of claim 13, wherein a perched position is defined by a user engaging the second placement zone.

19. The chair of claim 13, wherein an underside of the seat includes a pair of notches for receiving and partially surrounding at least a portion of each of the front legs.

* * * * *